US012790743B2

(12) United States Patent
Wakisaka et al.

(10) Patent No.: US 12,790,743 B2
(45) Date of Patent: Nov. 10, 2026

(54) ELECTROLESS PLATED FIBER MATERIAL, MANUFACTURING METHOD, AND MANUFACTURING SYSTEM THEREFOR

(71) Applicants: NATIONAL INSTITUTE OF ADVANCED INDUSTRIAL SCIENCE AND TECHNOLOGY, Tokyo (JP); ASANO FIBERS, INC., Kahoku (JP); YAMADA CO., LTD., Kanazawa (JP)

(72) Inventors: Akihiro Wakisaka, Tsukuba (JP); Miki Nakagawa, Tsukuba (JP); Hitomi Kobara, Tsukuba (JP); Takahiro Asano, Kahoku (JP); Takao Yamada, Kanazawa (JP)

(73) Assignees: NATIONAL INSTITUTE OF ADVANCED INDUSTRIAL SCIENCE AND TECHNOLOGY, Tokyo (JP); ASANO FIBERS, INC., Kahoku Ishikawa (JP); YAMADA CO., LTD., Kanazawa Ishikawa (JP)

( * ) Notice: Subject to any disclaimer, the term of this patent is extended or adjusted under 35 U.S.C. 154(b) by 881 days.

(21) Appl. No.: 17/997,220

(22) PCT Filed: Jun. 28, 2021

(86) PCT No.: PCT/JP2021/024330

§ 371 (c)(1),
(2) Date: Oct. 26, 2022

(87) PCT Pub. No.: WO2022/004646

PCT Pub. Date: Jan. 6, 2022

(65) Prior Publication Data

US 2023/0160139 A1 May 25, 2023

(30) Foreign Application Priority Data

Jul. 1, 2020 (JP) ..... 2020-114102

(51) Int. Cl.

| | |
|---|---|
| ***C23C 18/18*** | (2006.01) |
| ***C23C 18/16*** | (2006.01) |
| ***C23C 18/31*** | (2006.01) |
| ***C23C 18/52*** | (2006.01) |
| ***D06M 11/83*** | (2006.01) |

(52) U.S. Cl.
CPC ..... *D06M 11/83* (2013.01); *C23C 18/1658* (2013.01); *C23C 18/18* (2013.01); *C23C 18/31* (2013.01); *C23C 18/52* (2013.01)

(58) Field of Classification Search
CPC .... D06M 11/83; C23C 18/1658; C23C 18/18; C23C 18/31; C23C 18/52
USPC ..... 8/115.6
See application file for complete search history.

(56) References Cited

U.S. PATENT DOCUMENTS

| | | | |
|---|---|---|---|
| 3,877,965 | A | 4/1975 | Broadbent et al. |
| 2008/0210302 | A1 | 9/2008 | Gupta |
| 2014/0349034 | A1 | 11/2014 | Staberg et al. |

FOREIGN PATENT DOCUMENTS

| | | | | |
|---|---|---|---|---|
| EP | 3061848 | A1 * | 8/2016 | ..... D06M 10/06 |
| EP | 3061865 | A1 * | 8/2016 | ..... D06M 23/06 |
| JP | S5939361 | A | 3/1984 | |
| JP | H07173636 | A | 7/1995 | |
| JP | 2003105552 | A | 4/2003 | |
| JP | 2011236512 | A | 11/2011 | |
| JP | 2015214735 | A | 12/2015 | |
| WO | WO-2004068389 | A2 * | 8/2004 | ..... C23C 18/16 |
| WO | WO-2005045095 | A2 * | 5/2005 | ..... C23C 18/1608 |
| WO | 2015060341 | A1 | 4/2015 | |
| WO | 2015060342 | A1 | 4/2015 | |

OTHER PUBLICATIONS

"English language translation of International Search Report", International Application No. PCT/JP2021/024330, Aug. 24, 2021, 2 pp.
"Notice of Reasons for Refusal" and English language translation, JP Application No. 2020-114102, Jul. 26, 2024, 10 pp.

* cited by examiner

*Primary Examiner* — Amina S Khan
(74) *Attorney, Agent, or Firm* — Myers Bigel, P.A.

(57) ABSTRACT

The present invention relates to a manufacturing method for an electroless plated fiber material with reduced processing solution and improved quality. The manufacturing method electrostatically spraying a solution containing a catalyst precursor in a state of being electrically charged to a positive potential onto a fiber material while grounding the fiber material and moistening the fiber material, and electrostatically spraying a solution containing a reducing agent in a state of being electrically charged to a positive potential onto the fiber material, and a step of electrostatically spraying each of a solution containing metal ions and a solution containing a reducing agent each in a state of being electrically charged to a positive potential onto the fiber material such that the solution containing metal ions and the solution E containing the reducing agent react with each other in the same electric field on the fiber material while grounding the fiber material to which a catalyst is given and moistening the fiber material.

2 Claims, 4 Drawing Sheets

ELECTROLESS PLATED FIBER MATERIAL, MANUFACTURING METHOD, AND MANUFACTURING SYSTEM THEREFOR

RELATED APPLICATIONS

This application is a 35 U.S.C. § 371 national stage application of PCT Application No. PCT/JP2021/024330, filed on Jun. 28, 2021, which claims priority from Japanese Patent Application No. 2020-114102, filed on Jul. 1, 2020, the contents of which are incorporated herein by reference in their entireties. The above-referenced PCT International Application was published in the Japanese language as International Publication No. WO 2022/004646 A1 on Jan. 6, 2022.

TECHNICAL FIELD

The present invention relates to a manufacturing method for an electroless plated fiber material including a step of applying electroless plating processing to a fiber material with the use of a solution containing metal ions and a solution containing a reducing agent. The present invention relates to an electroless plated fiber material manufactured by such manufacturing method. The present invention also relates to a manufacturing system for an electroless plated fiber material, the manufacturing system including an electroless plating apparatus configured to apply electroless plating processing to a fiber material with the use of a solution containing metal ions and a solution containing a reducing agent.

BACKGROUND ART

Electroless plating processing may be applied to a fiber material in order to produce a fiber material having conductivity, for example. In the electroless plating processing, a plated film obtained by depositing metal by reducing metal ions with use of a reducing agent is formed on a fiber material. One example in a technology of manufacturing the electroless plated fiber material includes an electroless plating processing step of immersing a fiber material in a plating solution. (For example, see Patent Documents 1 to 3.)

Another example in the technology of manufacturing the electroless plated fiber material includes an electroless plating processing step of spraying a solution containing metal ions onto a fiber material containing a reducing agent by electrospraying, to thereby generate metal particles in the fiber material by a reaction between the metal ions and the reducing agent. (For example, see Patent Document 4.)

Yet another example in the technology of manufacturing the electroless plated fiber material includes an electroless plating processing step of spraying a solution containing metal ions in a state of being electrically charged to either a positive potential or a negative potential by electrospraying and spraying a solution containing a reducing agent in a state of being electrically charged to the other of the positive potential and the negative potential by electrospraying onto a fiber material, to thereby generate metal particles in the fiber material by a reaction between the metal ions and the reducing agent. (For example, see Patent Document 5.)

In one example, another example, and yet another example in the technology of manufacturing the electroless plated fiber material, preparation steps such as a cleaning processing step of immersing the fiber material in a cleaning fluid, a tannic acid processing step of immersing the fiber material in a tannic acid solution in order to increase the adhesion between the fiber material and the plated film, and a catalyzing processing step of immersing the fiber material in a catalyzing processing fluid in order to adhere a catalyst to the fiber material, are performed before the electroless plating processing step. (For example, see Patent Documents 1 to 5.)

CITATION LIST

Patent Literature

Patent Document 1: U.S. Pat. No. 3,877,965

Patent Document 2: Japanese Patent Laid-Open No. 7-173636

Patent Document 3: Japanese Patent Laid-Open No. 2003-105552

Patent Document 4: International Publication No. WO 2015/060341

Patent Document 5: International Publication No. WO 2015/060342

SUMMARY OF INVENTION

Problem to be Solved by the Invention

In the electroless plating processing step of one example in the technology of manufacturing the electroless plated fiber material and the preparation steps in one example and another example in the technology of manufacturing the electroless plated fiber material, the fiber material needs to be immersed in various processing solutions collected in a tank and the like. However, the processing solution may contain precious metal, and using a large amount of such processing solution increases the manufacturing cost. The solution after usage contains environmentally hazardous substances, and it incurs high costs to perform waste disposal processing of such solutions in a manner complying with environmental regulations. When the fiber material is immersed in the processing solution, batch processing needs to be performed in the tank in which the solution is collected and the like. The usage of an apparatus for performing the batch processing also causes the manufacturing cost to increase. The above also causes a decrease in the manufacturing efficiency of the electroless plated fiber material.

There is room for improvement for the electroless plated fiber material regarding increasing the quality thereof. For example, it has been desired that the conductivity of the electroless plated fiber material be increased and that the thickness of the plated film of the electroless plated fiber material be reduced.

In view of such actual circumstances, in the manufacturing method for the electroless plated fiber material, it is desired that the amount of the processing solution used be reduced, and the quality of the electroless plated fiber material manufactured be increased. In the manufacturing method for the electroless plated fiber material, it is desired that the conductivity of the electroless plated fiber material manufactured be increased, the thickness of the plated film of the electroless plated fiber material manufactured be reduced, the manufacturing cost of the electroless plated fiber material be reduced, the environmental load be reduced, and the manufacturing efficiency of the electroless plated fiber material be improved.

In the electroless plated fiber material, it is desired that the amount of the processing solution to be used at the time of manufacturing be reduced and the quality be increased. In the electroless plated fiber material, it is desired that the conductivity be increased, the thickness of the plated film be reduced, the manufacturing cost be reduced, the environmental load that may occur at the time of manufacturing be reduced, and the manufacturing efficiency be improved.

In a manufacturing system of the electroless plated fiber material, it is desired that the amount of the processing solution used be reduced and the quality of the electroless plated fiber material manufactured be increased. In the manufacturing system of the electroless plated fiber material, it is desired that the conductivity of the electroless plated fiber material manufactured be increased, the thickness of the plated film of the electroless plated fiber material manufactured be reduced, the manufacturing cost be reduced, the environmental load be reduced, and the manufacturing efficiency of the electroless plated fiber material be improved.

Means for Solving the Problems

A manufacturing method for an electroless plated fiber material according to one aspect includes: a catalyzing step of electrostatically spraying a catalyst solution containing a catalyst precursor in a state of being electrically charged to a positive potential or a negative potential onto a fiber material which is grounded or electrically charged to a potential opposite from the potential of the catalyst solution and which is moistened, and electrostatically spraying a first reducing agent solution containing a reducing agent of the catalyst precursor in a state of being electrically charged to a positive potential or a negative potential onto the fiber material which is grounded or electrically charged to a potential opposite from the potential of the first reducing agent solution and which is moistened, to thereby obtain a catalyst-applied fiber material in which a catalyst is given to the fiber material; and an electroless plating step of electrostatically spraying each of a metal ion solution containing metal ions and a second reducing agent solution containing a reducing agent of the metal ions, each in a state of being electrically charged to a positive potential or a negative potential in a similar manner, onto the catalyst-applied fiber material which is grounded or electrically charged to a potential opposite from the potential of the metal ion solution and the second reducing agent solution and which is moistened, such that the metal ion solution and the second reducing agent solution react with each other in the same electric field on the catalyst-applied fiber material, to thereby obtain an electroless plated fiber material in which a plated film is formed on the catalyst-applied fiber material.

An electroless plated fiber material according to one aspect is manufactured by a manufacturing method including: a catalyzing step of electrostatically spraying a catalyst solution containing a catalyst precursor in a state of being electrically charged to a positive potential or a negative potential onto a fiber material which is grounded or electrically charged to a potential opposite from the potential of the catalyst solution and which is moistened, and electrostatically spraying a first reducing agent solution containing a reducing agent of the catalyst precursor in a state of being electrically charged to a positive potential or a negative potential onto the fiber material which is grounded or electrically charged to a potential opposite from the potential of the first reducing agent solution and which is moistened, to thereby obtain a catalyst-applied fiber material in which a catalyst is applied to the fiber material; and an electroless plating step of electrostatically spraying each of a metal ion solution containing metal ions and a second reducing agent solution containing a reducing agent of the metal ions, each in a state of being electrically charged to a positive potential or a negative potential in a similar manner, onto the catalyst-applied fiber material which is grounded or electrically charged to a potential opposite from the potential of the metal ion solution and the second reducing agent solution and which is moistened, such that the metal ion solution and the second reducing agent solution react with each other in the same electric field on the catalyst-applied fiber material, to thereby obtain an electroless plated fiber material in which a plated film is formed on the catalyst-applied fiber material.

A manufacturing system of an electroless plated fiber material according to one aspect includes: a catalyzing apparatus configured to obtain a catalyst-applied fiber material in which a catalyst is applied to a fiber material; an electroless plating apparatus configured to obtain an electroless plated fiber material in which a plated film is formed on the catalyst-applied fiber material; and a fiber material sent to the catalyzing apparatus. In the manufacturing system, the catalyzing apparatus has: a nozzle for a catalyst configured to electrostatically spray a catalyst solution containing a catalyst precursor in a state of being electrically charged to a positive potential or a negative potential onto the fiber material which is grounded or electrically charged to a potential opposite from the potential of the catalyst solution and which is moistened; and a nozzle for a first reducing agent configured to electrostatically spray a first reducing agent solution containing a reducing agent of the catalyst precursor in a state of being electrically charged to a positive potential or a negative potential onto the fiber material which is grounded or electrically charged to a potential opposite from the potential of the first reducing agent solution and which is moistened, the electroless plating apparatus has: a nozzle for metal ions configured to electrostatically spray a metal ion solution containing metal ions in a state of being electrically charged to a positive potential or a negative potential onto the catalyst-applied fiber material; and a nozzle for second reducing agent configured to electrostatically spray a second reducing agent solution containing a reducing agent of the metal ions in a state of being electrically charged to the same potential as the potential of the metal ion solution onto the catalyst-applied fiber material, and the electroless plating apparatus is configured to cause the metal ion solution electrostatically sprayed from the nozzle for metal ions and the second reducing agent solution electrostatically sprayed from the nozzle for second reducing agent to react with each other in the same electric field on the catalyst-applied fiber material which is grounded or electrically charged to a potential opposite from the potential of the metal ion solution and the second reducing agent solution and which is moistened.

Advantageous Effects of Invention

In the manufacturing method for the electroless plated fiber material according to one aspect, the amount of the processing solution to be used can be reduced, and the quality of the electroless plated fiber material to be manufactured can be increased. In the manufacturing method for the electroless plated fiber material according to one aspect, the conductivity of the electroless plated fiber material to be manufactured can be increased, the thickness of the plated film of the electroless plated fiber material to be manufactured can be reduced, the manufacturing cost of the electroless plated fiber material can be reduced, the environmental load can be reduced, and the manufacturing efficiency of the electroless plated fiber material can be improved.

In the electroless plated fiber material according to one aspect, the amount of the processing solution to be used at the time of manufacturing can be reduced, and the quality can be increased. In the electroless plated fiber material according to one aspect, the conductivity can be increased, the thickness of the plated film can be reduced, the manufacturing cost can be reduced, the environmental load that may occur at the time of manufacturing can be reduced, and the manufacturing efficiency can be improved.

In the manufacturing system of the electroless plated fiber material according to one aspect, the amount of the processing solution to be used can be reduced, and the quality of the electroless plated fiber material to be manufactured can be increased. In the manufacturing system of the electroless plated fiber material according to one aspect, the conductivity of the electroless plated fiber material to be manufactured can be increased, the thickness of the plated film of the electroless plated fiber material to be manufactured can be reduced, the manufacturing cost can be reduced, the environmental load can be reduced, and the manufacturing efficiency of the electroless plated fiber material can be improved.

MODE FOR CARRYING OUT THE INVENTION

Electroless plated fiber materials and manufacturing methods and manufacturing systems thereof according to a first embodiment and a second embodiment are described below. In each of the manufacturing methods and the manufacturing systems according to the first and second embodiments, a fiber material having a plated film obtained by depositing metal by electroless plating processing, in other words, an electroless plated fiber material, is produced.

First Embodiment

The electroless plated fiber material and the manufacturing method and the manufacturing system thereof according to the first embodiment are described.

Overview of Electroless Plated Fiber Material and Manufacturing Method Therefor

Figure 1:
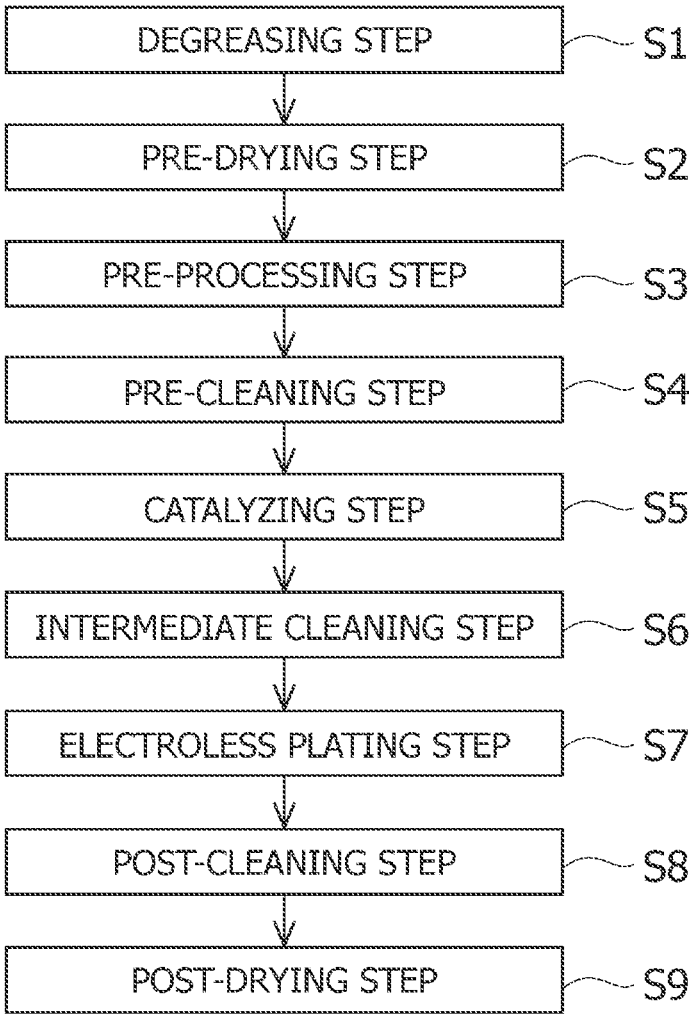
FIG. 1 is a flowchart for describing a manufacturing method for an electroless plated fiber material according to a first embodiment.

An outline of an electroless plated fiber material A4 and a manufacturing method therefor according to the present embodiment is described with reference to FIG. 1 to FIG. 3. As illustrated in FIG. 1, the manufacturing method for the electroless plated fiber material A4 roughly includes a catalyzing step S5 (details shown in FIG. 2) and an electroless plating step S7 (details shown in FIG. 3).

Figure 2:
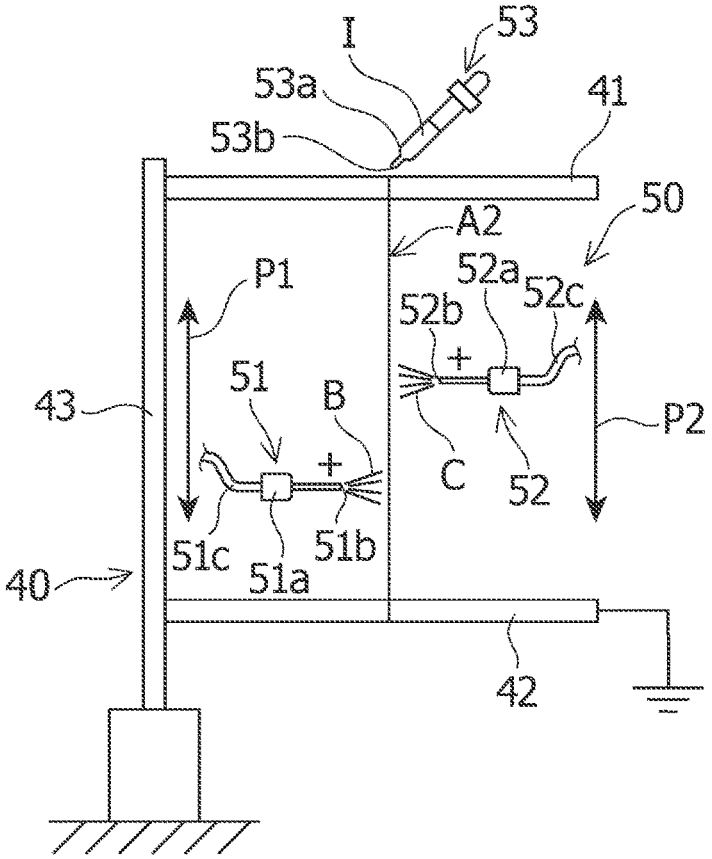
FIG. 2 is a front view schematically illustrating a catalyzing apparatus used in a catalyzing step of the manufacturing method for the electroless plated fiber material according to the first embodiment with a supporting apparatus that supports the fiber material.

In such a manufacturing method, as illustrated in FIG. 2, the following is performed in the catalyzing step S5. While a fiber material A2 described below is being grounded and the fiber material A2 is being moistened, a catalyst solution B that is a solution containing a catalyst precursor in a state of being electrically charged to a positive potential (indicated by character+) is electrostatically sprayed onto the fiber material A2. However, in the catalyzing step, instead of grounding the fiber material, the fiber material can be electrically charged to a potential opposite from the potential of the catalyst solution. The catalyst solution can also be electrostatically sprayed onto the fiber material in a state of being electrically charged to a negative potential.

In the catalyzing step S5, while the fiber material A2 is being grounded and the fiber material A2 is being moistened, a first reducing agent solution C that is a solution containing a reducing agent of the catalyst precursor in a state of being electrically charged to a positive potential (indicated by character+) is electrostatically sprayed onto the fiber material A2. The potential of the catalyst solution B and the potential of the first reducing agent solution C are the same.

However, in the catalyzing step, instead of grounding the fiber material, the fiber material can be electrically charged to a potential opposite of the potential of the first reducing agent solution. The first reducing agent solution can also be electrostatically sprayed onto the fiber material in a state of being electrically charged to a negative potential. The potential of the first reducing agent solution can also be different from the potential of the catalyst solution.

In the catalyzing step S5 as above, a catalyst-applied fiber material A3 in which a catalyst is applied to the fiber material A2 is obtained. The catalyst-applied fiber material A3 is simply referred to as a fiber material A3 as needed below.

Figure 3:
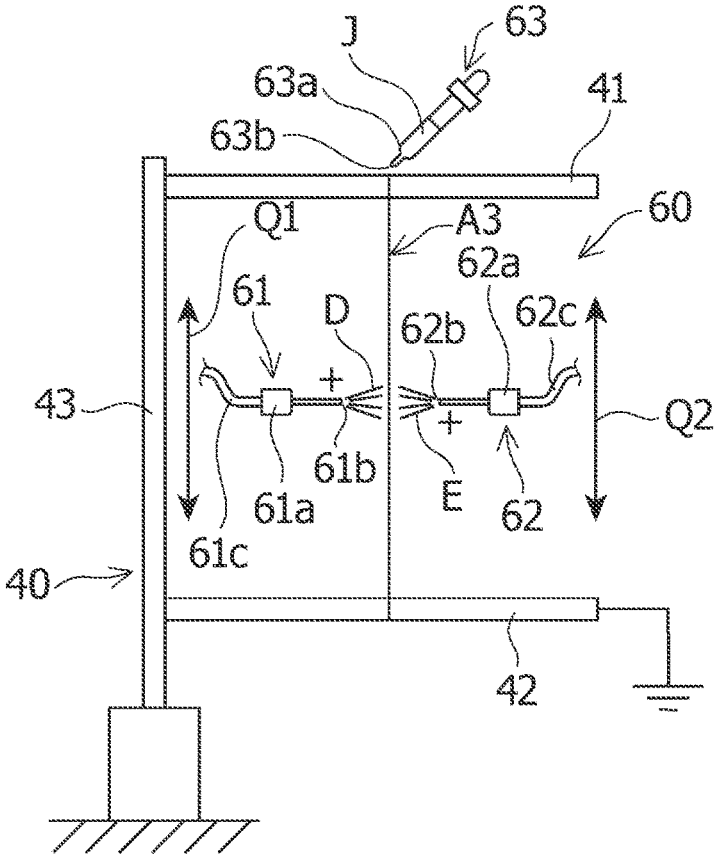
FIG. 3 is a front view schematically illustrating an electroless plating apparatus used in an electroless plating step of the manufacturing method for the electroless plated fiber material according to the first embodiment with the supporting apparatus.

As illustrated in FIG. 3, in the electroless plating step S7, while the catalyst-applied fiber material A3 is being grounded and the fiber material A3 is being moistened, each of a metal ion solution D that is a solution containing metal ions and a second reducing agent solution E that is a solution containing a reducing agent of the metal ions each in a state of being electrically charged to a positive potential (indicated by a "+") is electrostatically sprayed onto the fiber material A3 such that the metal ion solution D and the second reducing agent solution E react with each other in the same electric field on the fiber material A3. The potential of the metal ion solution D and the potential of the second reducing agent solution E are the same. The potentials of the metal ion solution D and the second reducing agent solution E are the same as the potentials of the catalyst solution B and the first reducing agent solution C.

However, in the electroless plating step, instead of grounding the fiber material, the fiber material can be electrically charged to a potential opposite of the potentials of the metal ion solution and the second reducing agent solution. The metal ion solution and the second reducing agent solution can also be electrostatically sprayed onto the fiber material in a state of being electrically charged to a negative potential. The potentials of the metal ion solution and the second reducing agent solution can also be different from one or both of the potentials of the catalyst solution and the first reducing agent solution.

In the electroless plating step S7 as above, an electroless plated fiber material A4, in which a plated film is formed on the fiber material A3, is obtained. The electroless plated fiber material A4 is simply referred to as a fiber material A4 as needed below. The electroless plated fiber material A4 according to the present embodiment can be generally manufactured by such manufacturing method.

Details of Electroless Plated Fiber Material and Manufacturing Method Therefor

Details of the electroless plated fiber material A4 and the manufacturing method therefor according to the present embodiment are described with reference to FIG. 1 to FIG. 6. As illustrated in FIG. 1, in detail, the manufacturing method for the electroless plated fiber material A4 can include a degreasing step S1 (details shown in FIG. 4), a pre-drying step S2, a pre-processing step S3 (details shown in FIG. 5), a pre-cleaning step S4 (details shown in FIG. 6), a catalyzing step S5 (details shown in FIG. 2), an intermediate cleaning step S6 (details shown in FIG. 6), an electroless plating step S7 (details shown in FIG. 3), a post-cleaning step S8 (details shown in FIG. 6), and a post-drying step S9.

Figure 4:
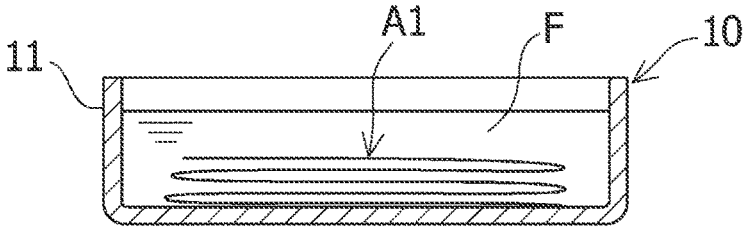
FIG. 4 is a cross-sectional view schematically illustrating a degreasing apparatus used in a degreasing step of the manufacturing method for the electroless plated fiber material according to the first embodiment.

In such manufacturing method, as illustrated in FIG. 4, a fiber material A1 is degreased in the degreasing step S1. Although not particularly clearly illustrated, the fiber material A1 is dried in the pre-drying step S2 after the degreasing step S1. It is also possible to omit the pre-drying step S2 when the degreasing fluid F is volatile.

Figure 5:
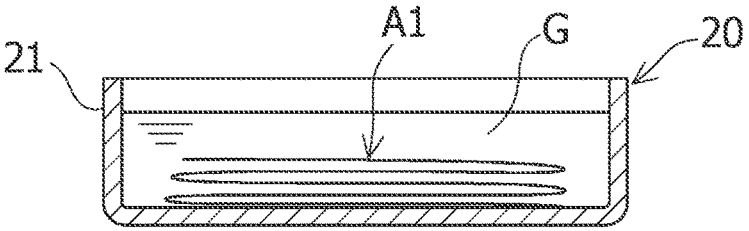
FIG. 5 is a cross-sectional view schematically illustrating a preprocessing apparatus used in a preprocessing step of the manufacturing method for the electroless plated fiber material according to the first embodiment.

As illustrated in FIG. 5, in the pre-processing step S3, pre-processing is applied so as to electrically charge the fiber material A1 dried in the pre-drying step S2 to a negative charge in order to increase the adhesion between the pre-processed fiber material A2 described below and the plated film. In the pre-processing step S3, the pre-processed fiber material A2 in which pre-processing is applied to the fiber material A1 is obtained. The pre-processed fiber material A2 is simply referred to as a fiber material A2 as needed below. However, it is also possible to omit the pre-processing step when one or both of the catalyzing step and the electroless plating processing step includes or include an operation of electrostatically spraying a solution electrically charged to a negative potential onto the fiber material as described above.

Figure 6:
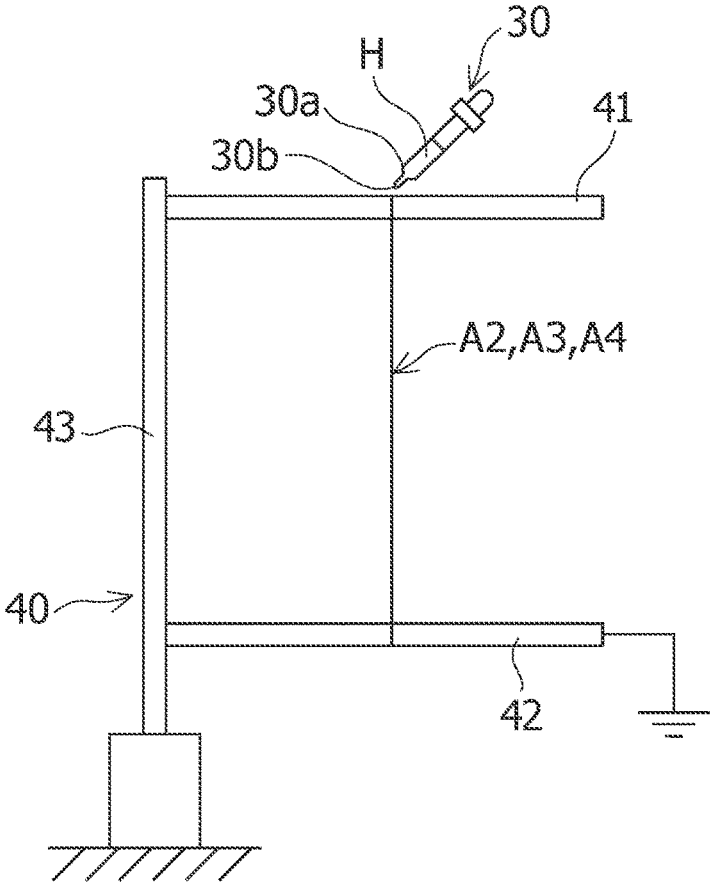
FIG. 6 is a front view schematically illustrating a cleaning apparatus used in each of a precleaning step, an intermediate cleaning step, and a post-cleaning step of the manufacturing method for the electroless plated fiber material according to the first embodiment with the supporting apparatus.

As illustrated in FIG. 6, after the pre-processing step S3, the pre-processed fiber material A2 is cleaned in the pre-cleaning step S4. As illustrated in FIG. 2, in the catalyzing step S5, while the fiber material A2 cleaned in the pre-cleaning step S4 is being grounded and the fiber material A2 is being moistened, the catalyst solution B in a state of being electrically charged to a positive potential is electrostatically sprayed onto the fiber material A2. In the catalyzing step S5, while the fiber material A2 is being grounded and the fiber material A2 is being moistened, the first reducing agent solution C in a state of being electrically charged to a positive potential is electrostatically sprayed onto the fiber material A2. In the catalyzing step S5, the catalyst-applied fiber material A3 is obtained.

As illustrated in FIG. 6, after the catalyzing step S5, the catalyst-applied fiber material A3 is cleaned in the intermediate cleaning step S6. As illustrated in FIG. 3, in the electroless plating step S7, while the fiber material A3 cleaned in the intermediate cleaning step S6 is being grounded and the fiber material A3 is being moistened, each of the metal ion solution D and the second reducing agent solution E each in a state of being electrically charged to a positive potential is electrostatically sprayed onto the fiber material A3 such that the metal ion solution D and the second reducing agent solution E react with each other in the same electric field on the fiber material A3. In the electroless plating step S7, the electroless plated fiber material A4 is obtained.

As illustrated in FIG. 6, after the electroless plating step S7, the electroless plated fiber material A4 is cleaned in the post-cleaning step S8. Although not particularly clearly illustrated, the fiber material A4 cleaned in the post-cleaning step S8 is dried in the post-drying step S9. The manufacturing method for the electroless plated fiber material can also include an annealing processing step of applying annealing processing to the electroless plated fiber material after the post-drying step. The electroless plated fiber material A4 according to the present embodiment can be manufactured by such manufacturing method in detail.

Details of Fiber Material

In detail, the fiber material A1 may be as follows. The specific material quality, the difference between natural fiber and synthetic fiber, the form of the material, and the like of the fiber material A1 are not particularly limited as long as the fiber material A1 is a filiform material containing a high polymer compound as a component or is a material (cotton, woven fabric, non-woven fabric, paper, and the like) obtained by bundling the filiform material. Examples of the type of the fiber material include plant fiber such as hemp and cotton, animal fiber such as wool and silk, regenerated fiber such as rayon, polyamide synthetic fiber such as nylon (nylon 6,6 and the like), polyester synthetic fiber, acrylic synthetic fiber, polyvinylalcohol synthetic fiber, polyolefin synthetic fiber, polyurethane synthetic fiber, cellulose semi-synthetic fiber, and protein-based semi-synthetic fiber. The fiber material is more preferably thread, woven fabric, non-woven fabric, knit fabric, paper, or film.

When the fiber material is thread, the thickness of the thread can be from about 30 denier to about 1200 denier, for example. The thickness of the thread is preferably from about 30 denier to about 300 denier.

The fiber material A1 is preferably hydrophilic considering the fact that the fiber materials A2, A3 are moistened in the catalyzing step S5 and the electroless plating step S7. However, the fiber material may be hydrophobic. In this case, processing for providing a hydrophilic property to the fiber material such as surface modification processing is preferably applied to the fiber material.

Details of Degreasing Step

In detail, the degreasing step S1 can be as follows, as illustrated in FIG. 4. In the degreasing step S1, the fiber material A1 is immersed in the degreasing fluid F. As a result, the fiber material A1 is degreased. In the degreasing step S1, raw thread oil, woven fabric oil, knit fabric oil, dirt, and the like can be removed from the fiber material A1.

In the degreasing step S1, a degreasing apparatus 10 configured to be able to degrease the fiber material A1 is used. The degreasing apparatus 10 has a tank 11 configured to be able to collect the degreasing fluid F. In the degreasing step S1, the entirety of the fiber material A1 is immersed in the degreasing fluid F in the tank 11.

As the degreasing fluid F, a degreasing fluid normally used in the degreasing of fiber can be used depending on the type of the fiber. For example, the degreasing fluid F can be an organic solvent containing acetone, isopropyl alcohol, ethanol, chloroform, methanol, xylene, and the like. The degreasing fluid F can be an alkaline cleaning agent containing caustic soda, sodium carbonate, sodium tertiary phosphate, sodium tripolyphosphate, sodium orthosilicate, sodium metasilicate, non-ionic surfactant, and the like.

The atmospheric temperature of the environment in which the degreasing step S1 is performed, in other words, the ambient temperature of the degreasing apparatus 10 can be room temperature. The processing temperature of the degreasing fluid F can be from normal temperature (about 20° C.) to about 80° C. The amount of immersing time by which the fiber material A1 is immersed in the degreasing fluid F can be from about one minute to about 10 minutes. However, the atmospheric temperature, the processing temperature, and the amount of immersing time are not limited to the above. The atmospheric temperature, the processing temperature, and the amount of immersing time can be adjusted, as appropriate, such that raw thread oil, woven fabric oil, knit fabric oil, dirt, and the like can be efficiency removed from the fiber material.

Details of Pre-Drying Step and Post-Drying Step

Although not particularly illustrated in a clear manner, the pre-drying step and post-drying step S2, S9 can be as follows. In the pre-drying step S2, warm air or hot air is applied to the fiber material A1 degreased in the degreasing step S1 so as to dry the fiber material A1. In the post-drying step S9, warm air or hot air is applied to the electroless plated fiber material A4 cleaned in the post-cleaning step S8 so as to dry the fiber material A4.

In each of the pre-drying step and post-drying step S2, S9, a drying apparatus (not shown) configured to be able to apply warm air or hot air to the fiber materials A1, A4 is used. However, the fiber material can also be naturally dried in either the pre-drying step or the post-drying step.

Details of Preprocessing Step

In detail, the preprocessing step S3 can be as follows as illustrated in FIG. 5. In the preprocessing step S3, the fiber material A1 is immersed in a processing fluid G containing a processing agent. As a result, the fiber material A1 is electrically charged to a negative charge. The adhesion between the preprocessing fiber material A2 and the plated film can be increased by the preprocessing step S3.

In the preprocessing step S3, a preprocessing apparatus 20 configured to be able to perform preprocessing that enables the adhesion between the fiber material A2 and the plated film to be increased is used. The preprocessing apparatus 20 has a tank 21 configured to be able to collect the processing fluid G. In the preprocessing step S3, the entirety of the fiber material A2 is immersed in the processing fluid Gin the tank 21.

The processing agent contained in the processing fluid G can be a solution containing a substance capable of providing a negative charge to the fiber material A1 such as a polyphenol compound such as tannic acid, gallic acid, pyrogallol, and catechol. By providing a negative charge to the fiber material A1 and electrically charging the fiber material A1 to be negative, the adhesiveness of the metal ions that serve as the catalyst precursor to the preprocessing fiber material A2 can be increased in the subsequent catalyzing step S5. The adhesion between the plated film formed thereafter and the catalyst-applied fiber material A3 can be increased. When the processing agent is tannic acid, the processing fluid G can also be referred to as a tannic acid solution G and the preprocessing step S3 can also be referred to as a tannic acid processing step S3. The concentration of the processing agent in the processing fluid G can be from about 0.1 mass % to about 5.0 mass %.

The atmospheric temperature of the environment in which the preprocessing step S3 is performed, in other words, the ambient temperature of the preprocessing apparatus 20, can be room temperature. The processing temperature of the processing fluid G can be from normal temperature (about 20° C.) to about 100° C. The amount of immersing time by which the fiber material A1 is immersed in the processing fluid G can be from about one minute to about 10 minutes. However, the atmospheric temperature, the processing temperature, and the amount of immersing time are not limited to the above. The atmospheric temperature, the processing temperature, and the amount of immersing time can be regulated, as appropriate, such that the adhesion between the fiber material and the plated film can be increased. The preprocessing step may be other processing normally performed as the preprocessing of the electroless plating of the fiber depending on the type of the fiber material and is not limited to the preprocessing using fluid.

Details of Pre-Cleaning Step, Intermediate Cleaning Step, and Post-Cleaning Step In detail, each of the pre-cleaning step, the intermediate step, and the post-cleaning step S4, S6, S8 can be as follows as illustrated in FIG. 6. In the pre-cleaning step S4, the cleaning fluid H is discharged to the preprocessing fiber material A2. As a result, the fiber material A2 is cleaned. In the intermediate cleaning step S6, the cleaning fluid H is discharged to the catalyst-applied fiber material A3. As a result, the fiber material A3 is cleaned. In the post-cleaning step S8, the cleaning fluid H is discharged to the electroless plated fiber material A4. As a result, the fiber material A4 is cleaned. In each of the pre-cleaning step, the intermediate step, and the post-cleaning step S4, S6, S8, a cleaning apparatus 30 that enables the cleaning fluid H to be discharged to the fiber materials A2, A3, A4 is used. The cleaning apparatus 30 includes a cleaning nozzle 30*a* having a discharge port 30*b* configured to discharge the cleaning fluid H.

However, the fiber material can also be cleaned by being immersed in the cleaning fluid in at least one of the pre-cleaning step, the intermediate cleaning step, and the post-cleaning step. In this case, a cleaning apparatus having a tank that can collect the cleaning fluid can be used in at least one of the pre-cleaning step, the intermediate cleaning step, and the post-cleaning step.

The cleaning fluid H can be water. The water can be purified water such as distilled water, ion exchanged water, reverse osmosis (RO) water, pure water, and ultrapure water, tap water, natural water, and the like. The cleaning fluids H of the pre-cleaning step, the intermediate cleaning step, and the post-cleaning step can be the same. However, the cleaning fluid is not limited to water. The cleaning fluids of the pre-cleaning step, the intermediate step, and the post-cleaning step S4, S6, S8 can be different from each other. One of the cleaning fluids of the pre-cleaning step, the intermediate cleaning step, and the post-cleaning step can also be different from the remaining two.

As illustrated in FIG. 6, the supporting apparatus 40 that supports the fiber materials A2, A3, A4 in the pre-cleaning step, the intermediate step, and the post-cleaning step S4, S6, S8 is described. The supporting apparatus 40 has two supporting portions 41, 42 disposed to be spaced apart from each other such that the fiber materials A2 to A4 are bridged thereover. One supporting portion 41 out of those two supporting portions 41, 42 is referred to as the first supporting portion 41, and the other supporting portion 42 out of the two supporting portions 41, 42 is referred to as the second supporting portion 42 as needed.

The supporting apparatus 40 has a coupling portion 43 that couples the first and second supporting portions 41, 42 to each other. The fiber materials A2 to A4 are bridged over the first and second supporting portions 41, 42 in a state of being applied with a predetermined tension. At this time, a tension with which slacks that cause the positions of the fiber materials A2 to A4 to vary in the radial direction are not generated, is preferably applied to the fiber materials A2 to A4. The supporting apparatus 40 is configured to fix the fiber materials A2 to A4 to the first and second supporting portions 41, 42. However, the supporting apparatus can be configured to move the fiber materials along the longitudinal direction thereof while supporting the fiber materials by the first and second supporting portions.

In FIG. 6, the first supporting portion 41 is disposed to be spaced apart from the second supporting portion 42 to the upper side. The fiber materials A2 to A4 are bridged over the first and second supporting portions 41, 42 so as to be substantially along the vertical direction. However, the disposal relationship between the first and second supporting portions is not limited to the above. For example, the first and second supporting portions can be disposed to be spaced apart from each other in the horizontal direction. In this case, the fiber materials can be bridged over the first and second supporting portions so as to be substantially along the horizontal direction.

One or both of the two supporting portions 41, 42 is or are configured to have conductivity and be electrically grounded. The fiber materials A2 to A4 are grounded via one or both of the two supporting portions 41, 42 as above. In FIG. 6, the second supporting portion 42 has conductivity and is electrically grounded. In this case, it is possible to cause the first supporting portion 41 to have conductivity or not have conductivity. However, it is also possible to cause the first supporting portion to have conductivity and be electrically grounded instead of the second supporting portion. Both of the first and second supporting portions can also be grounded.

As described above, when the first supporting portion 41 is disposed to be spaced apart from the second supporting portion 42 to the upper side and the fiber materials A2 to A4 are disposed to be substantially along the vertical direction, the discharge port 30*b* of the cleaning nozzle 30*a* of the cleaning apparatus 30 is disposed above the first supporting portion 41. The cleaning fluid H discharged from the discharge port 30*b* flows to the second supporting portion 42 from the first supporting portion 41 along the fiber materials A2 to A4 in accordance with gravity. The fiber materials A2 to A4 can be cleaned by the cleaning fluid H as above.

Although details are described below, the supporting apparatus 40 further supports the fiber materials A2, A3 in the catalyzing step S5 and the electroless plating step S7. The supporting apparatus 40 can also support the fiber material A4 in the post-drying step S9.

Details of Catalyzing Step

In detail, the catalyzing step S5 can be as follows as illustrated in FIG. 2. In the catalyzing step S5, the catalyst solution B is electrostatically sprayed onto the preprocessing fiber material A2 in advance, and the first reducing agent solution C is electrostatically sprayed onto the fiber material A2 following the catalyst solution B. However, in the catalyzing step, the catalyst solution and the first reducing agent solution can also be electrostatically sprayed onto the fiber material in a simultaneous manner. In the catalyzing step, it is also possible to electrostatically spray the first reducing agent solution onto the fiber material in advance and electrostatically spray the catalyst solution onto the fiber material following the first reducing agent solution.

In the catalyzing step S5, the fiber material A2 is supported by the supporting apparatus 40. In the catalyzing step S5, a catalyzing apparatus 50 configured to cause a reaction of applying a catalyst for an electroless plating reaction on the surface of the fiber material A2 is used.

The catalyzing apparatus 50 has a catalytic nozzle mechanism 51 for catalyst configured to be able to electrostatically spray the catalyst solution B. The nozzle mechanism 51 for catalyst has a nozzle 51*a* for a catalyst having a spraying port 51*b* that electrostatically sprays the catalyst solution B. As indicated by double-headed arrow P1, the nozzle 51*a* for catalyst is configured to be able to move along the longitudinal direction of the fiber material A2. The nozzle 51*a* for catalyst can repeatedly move back and forth along the longitudinal direction of the fiber material A2. The nozzle mechanism 51 for catalyst has a supply pipe 51*c* for a catalyst configured to enable the catalyst solution B to be supplied to the nozzle 51*a* for the catalyst to pass therethrough. A power source (not shown) can be used to electrically charge the catalyst solution B to a positive potential (or a negative potential).

In the nozzle mechanism 51 for a catalyst as above, the catalyst solution B is sprayed from the spraying port 51*b* of the nozzle 51*a* for catalyst through the supply pipe 51*c* for catalyst in a droplet state. At this time, an electric field can be generated between the nozzle 51*a* for a catalyst and the fiber material A2 by an electrospray phenomenon. When the fiber material is electrically charged to a potential opposite from the potential of the catalyst solution, the fiber material can be electrically charged to the opposite potential by use of the power source.

The electrospray phenomenon is described. For example, in the electric field between the nozzle 51*a* for catalyst of the nozzle mechanism 51 for catalyst and the fiber material A2, the side of the nozzle 51*a* for the catalyst is set to a positive potential, and the side of the grounded fiber material A2 is set to about 0 kV or a negative potential by using the power source and the like. The electrospray phenomenon can be caused to occur by providing a potential gradient between the nozzle 51*a* for catalyst and the fiber material A2 as above.

In a configuration in which the fiber material A2 is fixed to the first and second supporting portions 41, 42 of the supporting apparatus 40, the catalyst solution B can be sprayed onto the entirety of the fiber material A2 when the catalyst solution B is sprayed from the nozzle 51*a* for the catalyst while the nozzle 51*a* for catalyst is moved along the longitudinal direction of the fiber material A2. However, in a configuration in which the supporting apparatus moves the fiber material along the longitudinal direction thereof while supporting the fiber material by the first and second supporting portions as above, the catalyst solution can be sprayed onto the entirety of the fiber material even when the nozzle for catalyst is fixed to a certain position.

The catalyzing apparatus 50 has a nozzle mechanism 52 for first reducing agent configured to be able to electrostatically spray the first reducing agent solution C. The nozzle mechanism 52 for first reducing agent includes a nozzle 52*a* for first reducing agent having a spraying port 52*b* that electrostatically sprays the first reducing agent solution C. As indicated by double-headed arrow P2, the nozzle 52*a* for first reducing agent is configured to be able to move along the longitudinal direction of the fiber material A2. The nozzle 52*a* for first reducing agent can repeatedly move back and forth along the longitudinal direction of the fiber material A2. The nozzle mechanism 52 for a first reducing agent has a supply pipe 52*c* for a first reducing agent configured to enable the first reducing agent solution C to be supplied to the nozzle 52*a* for first reducing agent to pass therethrough. A power source (not shown) can be used to electrically charge the first reducing agent solution C to a positive potential (or a negative potential).

In the nozzle mechanism 52 for the first reducing agent as above, the first reducing agent solution C is sprayed from the spraying port 52*b* of the nozzle 52*a* for the first reducing agent through the supply pipe 52*c* for the first reducing agent in a droplet state. By the electrospray phenomenon similar to that of the nozzle mechanism 51 for catalyst, an electric field can be generated between the nozzle 52*a* for first reducing agent and the fiber material A2. When the fiber material is electrically charged to a potential opposite from the potential of the first reducing agent solution, the fiber material can be electrically charged to be the opposite potential by use of the power source.

In a configuration in which the fiber material A2 is fixed to the first and second supporting portions 41, 42 of the supporting apparatus 40, the first reducing agent solution C can be sprayed onto the entirety of the fiber material A2 when the first reducing agent solution C is sprayed from the nozzle 52*a* for first reducing agent while the nozzle 52*a* for first reducing agent is moved along the longitudinal direction of the fiber material A2. However, in a configuration in which the supporting apparatus moves the fiber material along the longitudinal direction thereof while supporting the fiber material by the first and second supporting portions as above, the first reducing agent solution can be sprayed onto the entirety of the fiber material even when the nozzle for the first reducing agent is fixed to a certain position.

Regarding the relationship between the nozzle mechanism 51 for a catalyst and the nozzle mechanism 52 for the first reducing agent, the nozzle 51*a* for the catalyst and the nozzle 52*a* for the first reducing agent are configured to be able to move so as not to hinder the movement of each other along the fiber material A2. In FIG. 2, the nozzle 51*a* for the catalyst and the nozzle 52*a* for first reducing agent are disposed to be shifted from each other in the circumferential direction of the fiber material A2. The nozzle 51*a* for the catalyst and the nozzle 52*a* for the first reducing agent can be disposed so as to face directions opposite from each other while the discharge ports 51*b*, 52*b* thereof face the fiber material A2. In this case, the distance between the discharge ports 51*b*, 52*b* in the longitudinal direction of the fiber material A2 can also be changed in accordance with the separate movements of the nozzle 51*a* for the catalyst and the nozzle 52*a* for the first reducing agent in the longitudinal direction of the fiber material A2.

However, the nozzle for the catalyst and the nozzle for the first reducing agent can also be disposed to be spaced apart from each other in the longitudinal direction of the fiber material. When one of the nozzle for the catalyst and the nozzle for the first reducing agent is disposed in an electrostatically spraying position at which the nozzle approaches the fiber material in order to perform electrostatically spraying onto the fiber material, the nozzle for the catalyst and the nozzle for the first reducing agent can also be switched with each other so as to cause the other nozzle to retreat from the electrostatically spraying position.

As one example, the catalyst solution B can be a solution in which a salt of one or a composite of platinum, gold, silver, palladium, and the like, a complex compound thereof, and the like, or a mixture of two or more of the above are dissolved. The salt can be nitrate, sulfate, chloride, acetate, and the like. Therefore, metal ions of platinum, gold, silver, palladium, and the like serving as the catalyst precursor are contained in the catalyst solution B.

In particular, in order to reduce the surface tension of droplets sprayed from the nozzle 51*a* for catalyst, the catalyst solution B can contain $C_1$-$C_3$ lower alcohols such as methanol, ethanol, and isopropyl alcohol; ketones such as acetone and methyl ethyl ketone; or a mixture of two or more of the above. The concentration of the catalyst precursor in the catalyst solution B can be adjusted, as appropriate. For example, the concentration of the catalyst precursor can be in a range of from about 0.01 mol/L or more and about 5 mol/L or less.

As the reducing agent contained in the first reducing agent solution C, an optimal reducing agent can be selected so as to be appropriate for the catalyst precursor species to be reduced. As one example, the reducing agent can be hydroxymethanesulfinic acid, thioglycolic acid, or sulfurous acid, salts thereof such as sodium salt, potassium salt, and ammonium salt, ascorbic acid, citric acid, sodium hydrosulfite, thiourea, dithiothreitol, hydrazines, formaldehydes, or boron hydrides, or a mixture of two or more thereof.

As one example, the hydrazines can be hydrazine, hydrazine hydrate, hydrazine salt, a substituent derivative of hydrazine or salt thereof, and the like. Specifically, examples include hydrazine hydrate, hydrazine monohydrochloride, hydrazine dihydrochloride, hydrazine sulfate, hydrazine bromate, hydrazine carbonate, methylhydrazine, phenylhydrazine, tert-butylhydrazine hydrochloride, and carbohydrazide.

One example of formaldehydes can be formaldehyde, paraformaldehyde, or the like, or a mixture of two or more thereof. Boron hydrides refers to a reducing compound having a boron-hydrogen bond. Specifically, examples include sodium borohydride, potassium borohydride, lithium borohydride, sodium cyanotrihydroborate, lithium triethylborohydride, a tetrahydrofuran-borane complex, a dimethylamine-borane complex, a diphenylamine-borane complex, and a pyridine-borane complex. In particular, the reducing agent is preferably ascorbic acid or a hydrazine.

The amount of the reducing agent added into the first reducing agent solution C can be adjusted, as appropriate, in correspondence with the type of the reducing agent, the concentration of the catalyst precursor in the catalyst solution B, and the like. For example, the amount of the reducing agent added is preferably in a range of from one time to two times as much as the chemical equivalent of the catalyst precursor. The reaction of reduction by the catalyst may not sufficiently progress when the amount of the reducing agent added is less than the chemical equivalent. In addition, the amount of the reducing agent added can exceed an amount that is two times as much as the chemical equivalent, but the cost increases.

The catalyst solution B and the first reducing agent solution C are preferably water-soluble or aqueous solution systems that are compatible with each other. As one example, the solvent used in each of the catalyst solution B and the first reducing agent solution C can be water, ethanol, DMF (N,N-dimethylformamide), acetone, or a mixture of two or more of the above. In particular, the solvent used in each of the catalyst solution B and the first reducing agent solution C is preferably water, or an aqueous solution of water and a water-soluble solvent such as ethanol, DMF, and acetone. The solvents used in the catalyst solution B and the first reducing agent solution C are preferably the same type.

In the nozzle 51*a* for catalyst and the nozzle 52*a* for first reducing agent, the diameter of each of the spraying ports 51*b*, 52*b* can be about 0.03 mm or more, preferably about 0.05 mm or more, and more preferably about 0.1 mm or more, and can be about 1.0 mm or less, preferably about 0.5 mm or less, and more preferably about 0.3 mm or less. The atmospheric temperature of the environment in which the catalyzing step S5 is performed, in other words, the ambient temperature of the catalyzing apparatus 50 can be room temperature.

In the catalyzing step S5, each of the distance between the spraying port 51*b* of the nozzle 51*a* for catalyst and the fiber material A2 and the distance between the spraying port 52*b* of the nozzle 52*a* for first reducing agent and the fiber material A2 can be about 5 mm or more, preferably about 7 mm or more, and more preferably about 10 mm or more, and can be about 40 mm or less, preferably about 30 mm or less, and more preferably about 20 mm or less.

In the catalyzing step S5, each of the spraying amount of the catalyst solution B from the nozzle 51*a* for catalyst per unit time and the spraying amount of the first reducing agent solution C from the nozzle 52*a* for first reducing agent per unit time can be about 3 μL/min or more, preferably about 5 μL/min or more, and more preferably about 7 μL/min or more, and can be about 50 μL/min or less, preferably about 30 μL/min or less, and more preferably about 20 μL/min or less. In the catalyzing step S5, each of the positive potential on the side of the nozzle 51*a* for catalyst and the positive potential on the side of the nozzle 52*a* for first reducing agent can be about +2.0 kV or more, preferably about +3.0 kV or more, and more preferably about +4.5 kV or more, and can be about +10.0 kV or less, preferably about +8 kV or less, and more preferably about +7 kV or less.

In the catalyzing step S5, water I is discharged to the fiber material A2. As a result, the fiber material A2 is moistened. The fiber material A2 can be reliably grounded by moistening the fiber material A2. The catalyzing apparatus 50 has a first moisture supplying mechanism 53 configured to supply the water I to the fiber material A2. The first moisture supplying mechanism 53 has a first moisture supplying nozzle 53*a* having a discharge port 53*b* configured to discharge the water I. The supplying of the water I to the fiber material A2 may be continuously performed or be intermittently performed while the catalyzing step S5 is performed.

In the catalyzing step S5, the water I for moistening the fiber material A2 can be purified water such as distilled water, ion exchanged water, reverse osmosis (RO) water, pure water, and ultrapure water. However, the water is not limited to the above.

As described above, when the first supporting portion 41 is disposed to be spaced apart from the second supporting portion 42 to the upper side and the fiber material A2 is disposed to be substantially along the vertical direction, the discharge port 53*b* of the first moisture supplying nozzle 53*a* is disposed above the first supporting portion 41. The water I discharged from the discharge port 53*b* flows to the second supporting portion 42 from the first supporting portion 41 along the fiber material A2 in accordance with gravity. By the water I as above, the fiber material A2 can be moistened.

However, the first moisture supplying mechanism can be configured to have a tank configured to be able to collect water when the supporting apparatus is configured to move the fiber material along the longitudinal direction thereof while supporting the fiber material by the first and second supporting portions as described above. In this case, the fiber material can pass through the water in the tank of the first moisture supplying mechanism in one or both of the time immediately before the catalyst solution is sprayed or the time immediately before the first reducing agent solution is sprayed.

By the catalyzing step S5, a catalyst metal film, for example, a film of metal palladium or platinum, can be formed on the fiber material A2. The amount of the catalyst given to the fiber material A2 can be adjusted, as appropriate, in the electroless plating step S7 thereafter such that the electroless plated fiber material A4 having a desired electric resistance value, a desired film thickness of the plated metal film, and the like can be obtained.

Details of Electroless Plating Step

In detail, the electroless plating step S7 can be as follows as illustrated in FIG. 3. In the electroless plating step S7, each of the metal ion solution D and the second reducing agent solution E, each in a state of being electrically charged to a positive potential, is electrostatically sprayed onto the fiber material A3 in a simultaneous manner such that the metal ion solution D and the second reducing agent solution E react with each other in the same electric field on the catalyst-applied fiber material A3.

In the electroless plating step S7, the fiber material A3 is supported by the supporting apparatus 40. In the electroless plating step S7, an electroless plating apparatus 60 configured to perform the electroless plating processing on the fiber material A3 is used.

The electroless plating apparatus 60 has a nozzle mechanism 61 for metal ions configured to be able to electrostatically spray the metal ion solution D. The nozzle mechanism 61 for metal ions has a nozzle 61*a* for metal ions having a spraying port 61*b* that electrostatically sprays the metal ion solution D. As indicated by double-headed arrow Q1, the nozzle 61*a* for metal ions is configured to be able to move along the longitudinal direction of the fiber material A3. The nozzle mechanism 61 for metal ions has a supply pipe 61*c* for metal ions configured to enable the metal ion solution D to be supplied to the nozzle 61*a* for metal ions to pass therethrough. A power source (not shown) can be used to electrically charge the metal ion solution D to a positive potential (or a negative potential).

In the nozzle mechanism 61 for metal ions as above, the metal ion solution D is sprayed from the spraying port 61*b* of the nozzle 61*a* for metal ions through the supply pipe 61*c* for metal ions in a droplet state. At this time, by the electrospray phenomenon similar to that of the nozzle mechanism 51 for catalyst described above, an electric field can be generated between the nozzle 61*a* for metal ions and the fiber material A3. When the fiber material is electrically charged to a potential opposite from the potential of the metal ion solution, the fiber material can be electrically charged to the opposite potential with use of the power source.

In a configuration in which the fiber material A3 is fixed to the first and second supporting portions 41, 42 of the supporting apparatus 40, the metal ion solution D can be sprayed onto the entirety of the fiber material A3 when the metal ion solution D is sprayed from the nozzle 61*a* for metal ions while the nozzle 61*a* for metal ions is moved along the longitudinal direction of the fiber material A3. However, in a configuration in which the supporting apparatus moves the fiber material along the longitudinal direction thereof while supporting the fiber material by the first and second supporting portions as above, the metal ion solution can be sprayed onto the entirety of the fiber material even when the nozzle for metal ions is fixed at a certain position.

The electroless plating apparatus 60 has a nozzle mechanism 62 for a second reducing agent configured to be able to electrostatically spray the second reducing agent solution E. The nozzle mechanism 62 for the second reducing agent is configured in a similar manner as the nozzle mechanism 52 for the first reducing agent besides the feature in which the second reducing agent solution E is electrostatically sprayed instead of the first reducing agent solution C. A nozzle 62*a* for the second reducing agent, a spraying port 62*b*, and a supply pipe 62*c* for the second reducing agent of the nozzle mechanism 62 for the second reducing agent are equivalent to the nozzle 52*a* for the first reducing agent, the spraying port 52*b*, and the supply pipe 52*c* for the first reducing agent of the nozzle mechanism 52 for the first reducing agent, respectively.

As indicated by double-headed arrow Q2, the nozzle 62*a* for the second reducing agent can move along the longitudinal direction of the fiber material A3. A power source (not shown) can be used to electrically charge the second reducing agent solution E to a positive potential (or a negative potential). When the fiber material is electrically charged to a potential opposite from the potential of the second reducing agent solution, the fiber material can be electrically charged to the opposite potential by use of the power source.

In the electroless plating apparatus, it is also possible to use the nozzle mechanism for the first reducing agent instead of the nozzle mechanism for the second reducing agent. In this case, the nozzle mechanism for the first reducing agent is used in common in the catalyzing apparatus and the electroless plating apparatus.

Regarding the relationship between the nozzle mechanism 61 for metal ions and the nozzle mechanism 62 for the second reducing agent, the nozzle 61*a* for metal ions and the nozzle 62*a* for the second reducing agent are configured to be able to move so as not to hinder the movement of each other along the fiber material A3. In FIG. 3, the nozzle 61*a* for metal ions and the nozzle 62*a* for the second reducing agent are disposed to be shifted from each other in the circumferential direction of the fiber material A3. The nozzle 61*a* for metal ions and the nozzle 62*a* for the second reducing agent can be disposed to be maintained in a state of facing each other while the discharge ports 61*b*, 62*b* face the fiber material A3.

The metal ions contained in the metal ion solution D may be ions of desired metal to be plated on the fiber material A3. Therefore, as one example, the metal ion solution D can be a solution obtained by dissolving salt of one or a composite of platinum, gold, silver, copper, tin, nickel, iron, palladium, zinc, iron, cobalt, tungsten, ruthenium, indium, molybdenum, and the like, a complex compound thereof, and the like, or a mixture of two or more of the above in an appropriate solvent. The salt can be nitrate, sulfate, chloride, acetate, and the like.

In particular, in order to reduce the surface tension of the droplets sprayed from the nozzle 61*a* for metal ions, the metal ion solution D can contain $C_1$-$C_3$ lower alcohols such as methanol, ethanol, and isopropyl alcohol; ketones such as acetone and methyl ethyl ketone; or a mixture of two or more of the above. The concentration of the metal ions in the metal ion solution D can be adjusted, as appropriate. For example, the concentration of the metal ions can be in a range of from 0.01 mol/L or more and about 5 mol/L or less.

As the reducing agent contained in the second reducing agent solution E, an optimal reducing agent can be selected so as to comply with the metal ion species to be reduced. Examples of the reducing agent contained in the second reducing agent solution E can include reducing agents similar to the reducing agents contained in the first reducing agent solution C.

The amount of the reducing agent added into the second reducing agent solution E can be adjusted, as appropriate, in correspondence with the type of the reducing agent, the concentration of the metal ions in the metal ion solution D, and the like. For example, the amount of the reducing agent added is preferably in a range of from one time to two times as much as the chemical equivalent of the metal ions. The reaction of reduction to the metal ions may not sufficiently progress when the amount of the reducing agent added is less than the chemical equivalent. In addition, the amount of the reducing agent added can exceed an amount that is two times as much as the chemical equivalent, but the cost increases.

The metal ion solution D and the second reducing agent solution E are preferably water-soluble or aqueous solution systems that are compatible with each other. As one example, the solvent used in each of the metal ion solution D and the second reducing agent solution E can be water, ethanol, DMF, acetone, or a mixture of two or more of the above. In particular, the solvent used in each of the metal ion solution D and the second reducing agent solution E is preferably water, or an aqueous solution of water and a water-soluble solvent such as ethanol, DMF, and acetone. The solvents used in the metal ion solution D and the second reducing agent solution E are preferably of the same type.

In the electroless plating step S7, water J is discharged to the fiber material A3. As a result, the fiber material A3 is moistened. The electroless plating apparatus 60 has a second moisture supplying mechanism 63 configured to supply the water J to the fiber material A3. The second moisture supplying mechanism 63 has a second moisture supplying nozzle 63*a* having a discharge port 63*b* configured to discharge the water J. The supplying of the water J to the fiber material A3 may be continuously performed or be intermittently performed while the electroless plating step S7 is performed.

In the nozzle 61*a* for metal ions and the nozzle 62*a* for second reducing agent, the diameter of each of the spraying ports 61*b*, 62*b* can be about 0.03 mm or more, preferably about 0.05 mm or more, and more preferably about 0.1 mm or more, and can be about 1.0 mm or less, preferably about 0.5 mm or less, and more preferably about 0.3 mm or less. The atmospheric temperature of the environment in which the electroless plating step S7 is performed, in other words, the ambient temperature of the electroless plating apparatus 60, can be room temperature.

In the electroless plating step S7, each of the distance between the spraying port 61*b* of the nozzle 61*a* for metal ions and the fiber material A3 and the distance between the spraying port 62*b* of the nozzle 62*a* for second reducing agent and the fiber material A3 can be about 5 mm or more, preferably about 7 mm or more, and more preferably about 10 mm or more, and can be about 40 mm or less, preferably about 30 mm or less, and more preferably about 20 mm or less.

In the electroless plating step S7, each of the spraying amount of the metal ion solution D from the nozzle 61*a* for metal ions per unit time and the spraying amount of the second reducing agent solution E from the nozzle 62*a* for second reducing agent per unit time can be about 3 μL/min or more, preferably about 5 μL/min or more, and more preferably about 7 μL/min or more, and can be about 50

μL/min or less, preferably about 30 μL/min or less, and more preferably about 20 μL/min or less. In the electroless plating step S7, each of the positive potential on the side of the nozzle 61*a* for metal ions and the positive potential on the side of the nozzle 62*a* for the second reducing agent can be about +2.0 kV or more, preferably about +3.0 kV or more, and more preferably about +4.5 kV or more, and can be about +10.0 kV or less, preferably about +8 kV or less, and more preferably about +7 kV or less.

In the electroless plating step S7, the water J for moistening the fiber material A3 can be purified water such as distilled water, ion exchanged water, RO water, pure water, and ultrapure water. The water J used in the electroless plating step S7 can be the same type as the water I used in the catalyzing step S5. The water J used in the electroless plating step S7 can also be a type different from that of the water I used in the catalyzing step S5. However, the water is not limited to the above.

In the electroless plating apparatus, it is also possible to use the first moisture supplying mechanism instead of the second moisture supplying mechanism. In this case, the first moisture supplying mechanism is used in common in the catalyzing apparatus and the electroless plating apparatus.

As described above, when the first supporting portion 41 is disposed to be spaced apart from the second supporting portion 42 to the upper side and the fiber material A3 is disposed to be substantially along the vertical direction, the discharge port 63*b* of the second moisture supplying nozzle 63*a* is disposed above the first supporting portion 41. The water J discharged from the discharge port 63*b* flows to the second supporting portion 42 from the first supporting portion 41 along the fiber material A3 in accordance with gravity. By the water J as above, the fiber material A3 can be moistened.

However, the second moisture supplying mechanism can be configured to have a tank configured to be able to collect water when the supporting apparatus is configured to move the fiber material along the longitudinal direction thereof while supporting the fiber material by the first and second supporting portions as described above. In this case, the fiber material can pass through the water in the tank of the second moisture supplying mechanism immediately before the metal ion solution and the second reducing agent solution are sprayed.

By the electroless plating step S7, a desired plated metal film can be formed on the catalyst metal film given to the fiber material A3. In the electroless plated fiber material A4 on which the plated metal film is formed by the electroless plating step S7, the film thickness of the plated metal film can be reduced while the electric resistance value thereof is reduced as compared to the related art. Examples of the related art include a commercially available silver-plated conductive thread in which the electric resistance value is about 2.0 Ω/cm and the film thickness of the plated metal film is about 2.1 μm. For example, in the plated metal film of the electroless plated fiber material A4, the electric resistance value can be set to about 2.0 Ω/cm or less, and the film thickness of the plated metal film can be set in a range equal to or less than about 0.4 μm.

Manufacturing System for Electroless Plated Fiber Material

With reference to FIG. 2 to FIG. 6, the manufacturing system of the electroless plated fiber material A4 capable of performing the manufacturing method for the electroless plated fiber material A4 according to the present embodiment is configured as follows. In other words, the manufacturing system roughly has the catalyzing apparatus 50 and the electroless plating apparatus 60. The catalyzing apparatus 50 is configured to be able to perform the catalyzing step S5. The electroless plating apparatus 60 is configured to be able to perform the electroless plating step S7.

In detail, the manufacturing system can have the degreasing apparatus 10, the preprocessing apparatus 20, the cleaning apparatus 30, the supporting apparatus 40, the catalyzing apparatus 50, the electroless plating apparatus 60, and the drying apparatus (not shown). The degreasing apparatus 10 is configured to be able to perform the degreasing step S1. The preprocessing apparatus 20 is configured to be able to perform the preprocessing step S3. The cleaning apparatus 30 is configured to be able to perform the pre-cleaning step, the intermediate cleaning step, and the post-cleaning step S4, S6, S8. The supporting apparatus 40 is configured to be able to support the fiber materials A2 to A4. The drying apparatus is configured to be able to perform the pre-drying step and post-drying step S2, S9.

When the manufacturing method for the electroless plated fiber material includes the annealing processing step, the manufacturing system of the electroless plated fiber material can include the annealing processing apparatus configured to be able to perform the annealing processing step. For example, the annealing processing apparatus can have a heating mechanism configured to be able to heat the fiber material. The heating mechanism can be a hot-air circulation oven. In this case, the annealing processing apparatus can also serve as the drying apparatus. The apparatus can also be referred to as a drying/annealing processing apparatus.

As above, the manufacturing method for the electroless plated fiber material A4 according to the present embodiment includes the electroless plating step S7 of electrostatically spraying the catalyst solution B containing a catalyst precursor in a state of being electrically charged to a positive potential or a negative potential onto the fiber material A2 which is grounded or electrically charged to a potential opposite from the potential of the catalyst solution B and which is moistened, and electrostatically spraying the first reducing agent solution C containing a reducing agent of the catalyst precursor in a state of being electrically charged to a positive potential or a negative potential onto the fiber material A2 which is grounded or electrically charged to a potential opposite from the potential of the first reducing agent solution C and which is moistened, to thereby electrostatically spray each of the metal ion solution D containing metal ions and the second reducing agent solution E containing a reducing agent of the metal ions each in a state of being electrically charged to a positive potential or a negative potential in a similar manner onto the catalyst-applied fiber material A3 which is grounded or electrically charged to a potential opposite from the potential of the metal ion solution D and the second reducing agent solution E and which is moistened, such that the metal ion solution D and the second reducing agent solution E react with each other in a same electric field on the catalyst-applied fiber material A3, to thereby obtain the electroless plated fiber material A4 in which a plated film is formed on the catalyst-applied fiber material A3.

An electroless plated fiber material A4 according to the present embodiment is manufactured by a manufacturing method including the electroless plating step S7 of electrostatically spraying the catalyst solution B containing a catalyst precursor in a state of being electrically charged to a positive potential or a negative potential onto the fiber material A2 which is grounded or electrically charged to a potential opposite from the potential of the catalyst solution B and which is moistened, and electrostatically spraying the first reducing agent solution C containing a reducing agent of the catalyst precursor in a state of being electrically charged to a positive potential or a negative potential onto the fiber material A2 which is grounded or electrically charged to a potential opposite from the potential of the first reducing agent solution C and which is moistened, to thereby electrostatically spray each of the metal ion solution D containing metal ions and the second reducing agent solution E containing a reducing agent of the metal ions each in a state of being electrically charged to a positive potential or a negative potential in a similar manner onto the catalyst-applied fiber material A3 which is grounded or electrically charged to a potential opposite from the potential of the metal ion solution D and the second reducing agent solution E and which is moistened, such that the metal ion solution D and the second reducing agent solution E react with each other in a same electric field on the catalyst-applied fiber material A3, to thereby obtain the electroless plated fiber material A4 in which a plated film is formed on the catalyst-applied fiber material A3.

A manufacturing system of an electroless plated fiber material A4 according to the present embodiment includes: a catalyzing apparatus 50 configured to obtain the catalyst-applied fiber material A3 in which a catalyst is given to the fiber material A2; and the electroless plating apparatus 60 configured to obtain an electroless plated fiber material A4 in which a plated film is formed on the catalyst-applied fiber material A3. In the manufacturing system, the catalyzing apparatus 50 has: the nozzle 51*a* for a catalyst configured to electrostatically spray the catalyst solution B containing a catalyst precursor in a state of being electrically charged to a positive potential or a negative potential onto the fiber material A2 which is grounded or electrically charged to a potential opposite from the potential of the catalyst solution B and which is moistened; and the nozzle 52*a* for first reducing agent configured to electrostatically spray the first reducing agent solution C containing a reducing agent of the catalyst precursor in a state of being electrically charged to a positive potential or a negative potential onto the fiber material A2 which is grounded or electrically charged to a potential opposite from the potential of the first reducing agent solution C and which is moistened, the electroless plating apparatus 60 has: the nozzle 61*a* for metal ions configured to electrostatically spray the metal ion solution D containing metal ions in a state of being electrically charged to a positive potential or a negative potential onto the catalyst-applied fiber material A3; and the nozzle 62*a* for second reducing agent configured to electrostatically spray the second reducing agent solution E containing a reducing agent of the metal ions in a state of being electrically charged to a same potential as the potential of the metal ion solution D onto the catalyst-applied fiber material A3, and the electroless plating apparatus 60 is configured to cause the metal ion solution D electrostatically sprayed from the nozzle 61*a* for metal ions and the second reducing agent solution E electrostatically sprayed from the nozzle 62*a* for second reducing agent to react with each other in a same electric field on the catalyst-applied fiber material A3 which is grounded or electrically charged to a potential opposite from the potential of the metal ion solution D and the second reducing agent solution E and which is moistened.

In each of the electroless plating step S7 and the electroless plating apparatus 60, the metal ion solution D and the second reducing agent solution E are electrically charged to the same potential when the metal ion solution D and the second reducing agent solution E are electrostatically sprayed. Therefore, the metal ion solution D and the second reducing agent solution E do not collide with each other before reaching the fiber material A3. Then, the metal ion solution D and the second reducing agent solution E lose charges thereof when the metal ion solution D and the second reducing agent solution E reach the grounded fiber material A3. At this time, the metal ion solution D and the second reducing agent solution E come into contact, are mixed, and react with each other for the first time. Therefore, the metal ions of the metal ion solution D are efficiently reduced by the reducing agent of the second reducing agent solution E on the fiber material A3. As a result, a plated film obtained by depositing metal can be efficiently formed on the fiber material A3. In particular, the electroless plated fiber material A4 having such plated film can increase the conductivity thereof and reduce the thickness of the plated film. Therefore, the quality of the electroless plated fiber material A4 can be increased.

In the electroless plated fiber material A4 and the manufacturing method and the manufacturing system thereof as above, in each of the catalyzing step S5 and the catalyzing apparatus 50, the usage amount of the processing solution to be electrostatically sprayed can be reduced as compared to the usage amount of the processing solution used in immersing as in the related art. In each of the electroless plating step S7 and the electroless plating apparatus 60, the usage amount of the processing solution to be electrostatically sprayed can be reduced as compared to the usage amount of the processing solution used in immersing as in the related art. By the reduction of the usage amount of the processing solution as above, the manufacturing cost can be reduced, the environmental load can be reduced, and the manufacturing efficiency of the electroless plated fiber material A4 can be improved. In plating processing using a plating bath of the related art, the substance concentration in the plating bath changes over time. Therefore, the concentration management of the plating bath has been difficult. In the present invention, the processing solution is electrostatically sprayed, and hence problems relating to the concentration management of the plating bath can also be solved.

Second Embodiment

The electroless plated fiber material and the manufacturing method and the manufacturing system thereof according to the second embodiment are described. The fiber material A1 used in the present embodiment is similar to the fiber material A1 used in the first embodiment.

Figure 7:
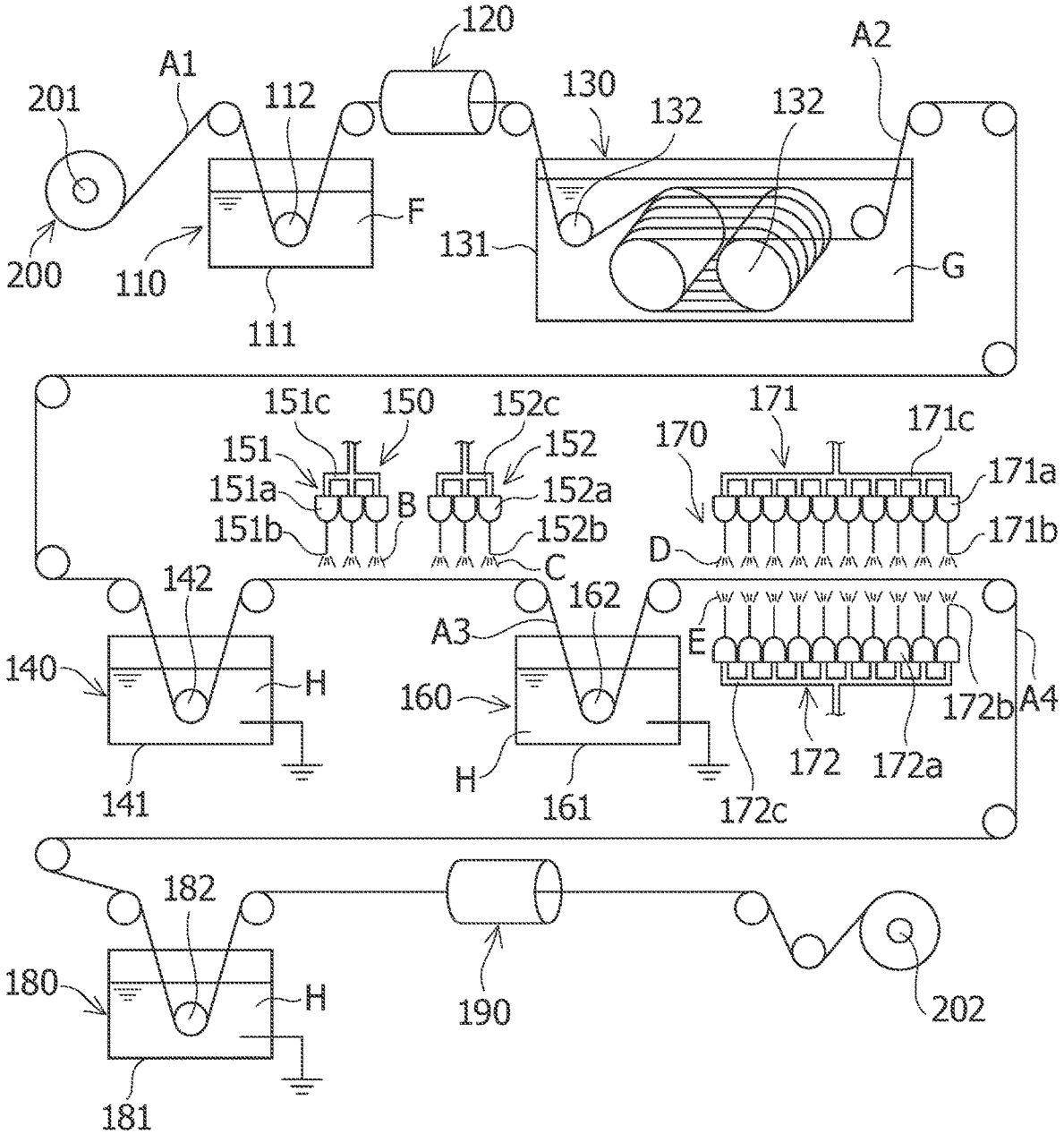
FIG. 7 is a schematic view of a manufacturing system of an electroless plated fiber material according to a second embodiment.

Overview of Electroless Plated Fiber Material and Manufacturing Method Therefor An outline of the electroless plated fiber material A4 and the manufacturing method thereof according to the present embodiment is described with reference to FIG. 1 and FIG. 7. The manufacturing method for the electroless plated fiber material A4 according to the present embodiment generally includes the catalyzing step S5 and the electroless plating processing step S7 similar to those in the first embodiment.

In the manufacturing method for the electroless plated fiber material A4 according to the present embodiment, the fiber material A2, the catalyst-applied fiber material A3, and the electroless plated fiber material A4 are integrated with each other so as to extend from the position in which the catalyzing step S5 is performed toward the position in which the electroless plating processing step S7 is performed. The fiber materials A2 to A4 integrated with each other as above are carried from the position in which the catalyzing step S5 is performed toward the position in which the electroless plating processing step S7 is performed. The electroless plated fiber material A4 according to the present embodiment can be generally manufactured by such manufacturing method.

Details of Electroless Plated Fiber Material and Manufacturing Method Therefor

Details of the electroless plated fiber material A4 and the manufacturing method therefor according to the present embodiment are described with reference to FIG. 1 and FIG. 7. In detail, the manufacturing method for the electroless plated fiber material A4 according to the present embodiment includes the degreasing step S1, the pre-drying step S2, the pre processing step S3, the pre-cleaning step S4, the catalyzing step S5, the intermediate cleaning step S6, the electroless plating step S7, the post-cleaning step S8, and the post-drying step S9 similar to those in the first embodiment. It is also possible to omit the pre-drying step S2 when the degreasing fluid F is volatile.

In the manufacturing method for the electroless plated fiber material A4 according to the present embodiment, the fiber material A1, the preprocessing fiber material A2, the catalyst-applied fiber material A3, and the electroless plated fiber material A4 are integrated with each other so as to extend from the position in which the degreasing step S1 is performed toward the position in which the post-drying step S9 is performed. The fiber materials A1 to A4 integrated with each other as above are carried from the position in which the degreasing step S1 is performed toward the position in which the post-drying step S9 is performed. The electroless plated fiber material A4 according to the present embodiment can be manufactured by such manufacturing method in detail.

Manufacturing System for Electroless Plated Fiber Material

The manufacturing system of the electroless plated fiber material A4 according to the present embodiment is described with reference to FIG. 7. Such manufacturing system generally includes a catalyzing apparatus 150, an electroless plating apparatus 170, and a carrying apparatus 200. The catalyzing apparatus 150 is configured to be able to perform the catalyzing step S5. The electroless plating apparatus 170 is configured to be able to perform the electroless plating step S7. The carrying apparatus 200 is configured to be able to carry the fiber materials A1 to A4.

In detail, the manufacturing system can have a degreasing apparatus 110, a pre-drying apparatus 120, a pre-processing apparatus 130, a pre-cleaning apparatus 140, the catalyzing apparatus 150, an intermediate cleaning apparatus 160, the electroless plating apparatus 170, a post-cleaning apparatus 180, a post-drying apparatus 190, and the carrying apparatus 200. The degreasing apparatus 110 is configured to be able to perform the degreasing step S1. The pre-drying apparatus 120 is configured to be able to perform the pre-drying step S2. The pre-processing apparatus 130 is configured to be able to perform the pre-processing step S3. The pre-cleaning apparatus 140 is configured to be able to perform the pre-cleaning step S4. The intermediate cleaning apparatus 160 is configured to be able to perform the intermediate cleaning step S6. The post-cleaning apparatus 180 is configured to be able to perform the post-cleaning step S8. The post-drying apparatus 190 is configured to be able to perform the post-drying step S9. The carrying apparatus 200 carries the fiber materials A1 to A4 such that the fiber materials A1 to A4 pass through the degreasing apparatus 110, the pre-drying apparatus 120, the preprocessing apparatus 130, the pre-cleaning apparatus 140, the catalyzing apparatus 150, the intermediate cleaning apparatus 160, the electroless plating apparatus 170, the post-cleaning apparatus 180, and the post-drying apparatus 190, in the stated order.

Details of Degreasing Apparatus

The degreasing apparatus 110 can be configured as follows with reference to FIG. 7. In the manufacturing system, the degreasing apparatus 110 has a tank 111 configured to be able to collect the degreasing fluid F. The degreasing apparatus 110 has a roller 112 for degreasing disposed in the degreasing fluid F collected in the tank 111. The fiber material A1 passes through the inside of the tank 111 while being guided by the roller 112 for degreasing so as to be immersed in the degreasing fluid F.

Details of Pre-Drying Apparatus

The pre-drying apparatus 120 can be configured as follows with reference to FIG. 7. The pre-drying apparatus 120 is configured to be able to apply warm air or hot air to the fiber material A1 that has passed through the degreasing apparatus 110. The fiber material A1 is dried when the fiber material A1 passes through the pre-drying apparatus 120. It is also possible to omit the pre-drying apparatus 120 when the degreasing fluid F is volatile.

Details of Preprocessing Apparatus

The pre-processing apparatus 130 can be configured as follows with reference to FIG. 7. The pre-processing apparatus 130 has a tank 131 configured to be able to collect the processing fluid G. The pre-processing apparatus 130 has a plurality of rollers 132 for preprocessing disposed in the processing fluid G collected in the tank 131. The fiber material A1 that has passed through the pre-drying apparatus 120 passes through the inside of the tank 131 while being guided by the plurality of rollers 132 for preprocessing so as to make a round trip in the processing fluid G in order to be immersed in the processing fluid G. In the preprocessing apparatus 130, the preprocessing fiber material A2 in a state obtained by applying pre-processing to the fiber material A1 is obtained.

Details of Pre-Cleaning Apparatus

The pre-cleaning apparatus 140 can be configured as follows with reference to FIG. 7. The pre-cleaning apparatus 140 has a tank 141 configured to be able to collect cleaning fluid H. The pre-cleaning apparatus 140 has a roller 142 for precleaning disposed in the cleaning fluid H collected in the tank 141. The preprocessing fiber material A2 that has passed through the pre-processing apparatus 130 passes through the inside of the tank 141 while being guided by the roller 142 for pre-cleaning so as to be cleaned by the cleaning fluid H. In the pre-cleaning apparatus 140, the fiber material A2 is grounded by the cleaning fluid H in the tank 141. As a result, the fiber material A2 positioned in the subsequent catalyzing apparatus 150 is also placed in the grounded state.

In the pre-cleaning apparatus 140, the fiber material A2 is moistened by the cleaning fluid H in the tank 141. As a result, the fiber material A2 positioned in the subsequent catalyzing apparatus 150 is also placed in a state in which it can be moistened. The cleaning fluid H as above can be the same as the water I used in the subsequent catalyzing apparatus 150.

Details of Catalyzing Apparatus

The catalyzing apparatus 150 can be configured as follows, with reference to FIG. 7. The catalyzing apparatus 150 has nozzles 151*a* for a catalyst each configured as with the nozzle 51*a* for the catalyst of the first embodiment. Each of the nozzles 151*a* for the catalyst has a spraying port 151*b* similar to the spraying port 51*b* of the nozzle 51*a* for catalyst of the first embodiment.

The catalyzing apparatus 150 has a nozzle mechanism 151 for the catalyst having the plurality of nozzles 151*a* for the catalyst. The nozzle mechanism 151 for the catalyst has a plurality of supply pipes 151*c* for the catalyst configured to feed the catalyst solution B to the plurality of nozzles 151*a* for the catalyst, respectively. However, the nozzle mechanism for the catalyst can also be configured to have one nozzle for the catalyst, and one supply pipe for the catalyst that feeds the catalyst solution to the nozzle for the catalyst.

The catalyzing apparatus 150 has nozzles 152*a* for first reducing agent configured as with the nozzle 52*a* for first reducing agent of the first embodiment. Each of the nozzles 152*a* for the first reducing agent has a spraying port 152*b* similar to the spraying port 52*b* of the nozzle 52*a* for the first reducing agent of the first embodiment.

The catalyzing apparatus 150 includes a nozzle mechanism 152 for the first reducing agent having the plurality of nozzles 152*a* for the first reducing agent. The nozzle mechanism 152 for the first reducing agent has a plurality of supply pipes 152*c* for the first reducing agent configured to feed the first reducing agent solution C to the plurality of nozzles 152*a* for the first reducing agent, respectively. However, the nozzle mechanism for the first reducing agent can also be configured to have one nozzle for the first reducing agent, and one supply pipe for the first reducing agent that feeds the first reducing agent solution to the nozzle for the first reducing agent.

The plurality of nozzles 151*a* for catalyst and the plurality of nozzles 152*a* for the first reducing agent are arranged side by side in the direction in which the fiber material A2 that passes through the catalyzing apparatus 150 is carried. The nozzle mechanism 151 for catalyst and the nozzle mechanism 152 for the first reducing agent are arranged side by side in the direction in which the fiber material A2 that passes through the catalyzing apparatus 150 is carried. The nozzle mechanism 151 for the catalyst is preferably positioned upstream of the nozzle mechanism 152 for the first reducing agent in the direction in which the fiber material A1 is carried. The nozzle mechanism 151 for the catalyst and the nozzle mechanism 152 for the first reducing agent can also be fixed.

However, the positions of the nozzle mechanism for the catalyst and the nozzle mechanism for the first reducing agent are not limited to the above. The nozzle mechanism for the catalyst can also be positioned downstream of the nozzle mechanism for the first reducing agent in the direction in which the fiber material is carried. One or both of the nozzle mechanism for the catalyst and the nozzle mechanism for the first reducing agent can also be movable.

Regarding the preprocessing fiber material A2 that has passed through the pre-cleaning apparatus 140, the catalyst solution B is electrostatically sprayed thereto by the nozzle mechanism 151 for the catalyst, and the first reducing agent solution C is electrostatically sprayed thereto by the nozzle mechanism 152 for the first reducing agent. At this time, the fiber material A2 that passes through the catalyzing apparatus 150 is grounded by the pre-cleaning apparatus 140 described above and the intermediate cleaning apparatus 160 described below. The fiber material A2 is moistened by the pre-cleaning apparatus 140 described above. In the catalyzing apparatus 150, the catalyst-applied fiber material A3 in a state obtained by giving the catalyst to the fiber material A2 is obtained.

Details of Intermediate Cleaning Apparatus

The intermediate cleaning apparatus 160 can be configured as follows with reference to FIG. 7. The intermediate cleaning apparatus 160 has a tank 161 configured to be able to collect the cleaning fluid H. The intermediate cleaning apparatus 160 has a roller 162 for intermediate cleaning disposed in the cleaning fluid H collected in the tank 161. The catalyst-applied fiber material A3 that has passed through the catalyzing apparatus 150 passes through the inside of the tank 161 while being guided by the roller 162 for intermediate cleaning so as to be cleaned by the cleaning fluid H. In the intermediate cleaning apparatus 160, the fiber material A3 is grounded by the cleaning fluid H in the tank 161. As a result, the fiber material A2 positioned in the preceding catalyzing apparatus 150 and the fiber material A3 positioned in the subsequent electroless plating apparatus 170 are also placed in the grounded state.

In the intermediate cleaning apparatus 160, the fiber material A3 is moistened by the cleaning fluid H in the tank 161. As a result, the fiber material A3 positioned in the subsequent electroless plating apparatus 170 is also placed in a state in which it is moistened. The cleaning fluid H as above can be the same as the water J used in the subsequent electroless plating apparatus 170.

Details of Electroless Plating Apparatus

The electroless plating apparatus 170 can be configured as follows, with reference to FIG. 7. The electroless plating apparatus 170 has nozzles 171*a* for metal ions configured as with the nozzle 61*a* for metal ions of the first embodiment. Each of the nozzles 171*a* for metal ions has a spraying port 171*b* similar to the spraying port 61*b* of the nozzle 61*a* for metal ions of the first embodiment.

The electroless plating apparatus 170 includes a nozzle mechanism 171 for metal ions having the plurality of nozzles 171*a* for metal ions. The nozzle mechanism 171 for metal ions has a plurality of supply pipes 171*c* for metal ions configured to feed the metal ion solution D to the plurality of nozzles 171*a* for metal ions, respectively. However, the nozzle mechanism for metal ions can also be configured to have one nozzle for metal ions, and one supply pipe for metal ions that feeds the metal ion solution to the nozzle for metal ions.

The electroless plating apparatus 170 has nozzles 172*a* for second reducing agent configured as with the nozzle 62*a* for second reducing agent of the first embodiment. Each of the nozzles 172*a* for second reducing agent has a spraying port 172*b* similar to the spraying port 62*b* of the nozzle 62*a* for the second reducing agent of the first embodiment.

The electroless plating apparatus 170 has a nozzle mechanism 172 for the second reducing agent having the plurality of nozzles 172*a* for the second reducing agent. The nozzle mechanism 172 for the second reducing agent has a plurality of supply pipes 172*c* for the second reducing agent configured to feed the second reducing agent solution E to the plurality of nozzles 172*a* for the second reducing agent, respectively. However, the nozzle mechanism for the second reducing agent can also be configured to have one nozzle for the second reducing agent, and one supply pipe for the second reducing agent that feeds the second reducing agent solution to the nozzle for the second reducing agent.

Regarding the relationship between the nozzle mechanism 171 for metal ions and the nozzle mechanism 172 for the second reducing agent, the nozzles 171*a* for metal ions and the nozzles 172*a* for the second reducing agent are fixed. In FIG. 7, the nozzles 171*a* for metal ions and the nozzles 172*a* for the second reducing agent are disposed to be shifted from each other in the circumferential direction of the fiber material A3. The nozzles 171*a* for metal ions and the nozzles 172*a* for the second reducing agent can be disposed to be maintained in a state of facing each other while the discharge ports 171*b*, 172*b* face the fiber material A3.

Regarding the catalyst-applied fiber material A3 that has passed through the intermediate cleaning apparatus 160, the metal ion solution C is electrostatically sprayed thereto by the nozzle mechanism 171 for metal ions, and the second reducing agent solution E is electrostatically sprayed thereto by the nozzle mechanism 172 for the second reducing agent. At this time, the fiber material A3 that passes through the electroless plating apparatus 170 is grounded by the intermediate cleaning apparatus 160 described above and the post-cleaning apparatus 180 described below. The fiber material A2 is moistened by the intermediate cleaning apparatus 160 described above. In the electroless plating apparatus 170, the electroless plated fiber material A4 in a state in which a plated film is formed on the fiber material A3 is obtained.

Details of Post-Cleaning Apparatus

The post-cleaning apparatus 180 can be configured as follows, with reference to FIG. 7. The post-cleaning apparatus 180 has a tank 181 configured to be able to collect the cleaning fluid H. The post-cleaning apparatus 180 has a roller 182 for post-cleaning disposed in the cleaning fluid H collected in the tank 181. The electroless plated fiber material A4 that has passed through the electroless plating apparatus 170 passes through the inside of the tank 181 while being guided by the roller 182 for post-cleaning so as to be cleaned by the cleaning fluid H. In the post-cleaning apparatus 180, the fiber material A4 is grounded by the cleaning fluid H in the tank 181. As a result, the fiber material A3 positioned in the preceding electroless plating apparatus 170 is placed in a grounded state.

Details of Post-Drying Apparatus

The post-drying apparatus 190 can be configured as follows, with reference to FIG. 7. The post-drying apparatus 190 is configured to be able to apply warm air or hot air to the fiber material A4 that has passed through the post-cleaning apparatus 180. The fiber material A4 is dried when the fiber material A1 passes through the post-drying apparatus 190.

The post-drying apparatus 190 can be configured to be able to also perform an annealing processing step. For example, the post-drying apparatus 190 can have a heating mechanism configured to be able to heat the fiber material A4. The heating mechanism can be a hot-air circulation oven. In this case, the apparatus can also be referred to as a drying and annealing processing apparatus. However, an annealing processing apparatus can also be provided separately from the post-drying apparatus.

Details of Carrying Apparatus

The carrying apparatus 200 can be configured as follows, with reference to FIG. 7. The carrying apparatus 200 has an unwinding roller 201 configured to unwind the fiber material A1. The carrying apparatus 200 has a winding roller 202 configured to wind the electroless plated fiber material A4. The fiber material A1, the preprocessing fiber material A2, the catalyst-applied fiber material A3, and the electroless plated fiber material A4 extend between the unwinding roller 201 and the winding roller 202 in an integrated manner.

The fiber material A1 unwound from the unwinding roller 201 passes through the place from the degreasing apparatus 110 to the preprocessing apparatus 130 and then changes into the preprocessing fiber material A2. The preprocessing fiber material A2 that has passed through the preprocessing apparatus 130 passes through the place from the pre-cleaning apparatus 140 to the catalyzing apparatus 150, and then changes to the catalyst-applied fiber material A3. The catalyst-applied fiber material A3 that has passed through the catalyzing apparatus 150 passes through the place from the intermediate cleaning apparatus 160 to the electroless plating apparatus 170 and then changes to the electroless plated fiber material A4. The electroless plated fiber material A4 that has passed through the electroless plating apparatus 170 passes through the place from the post-cleaning apparatus 180 to the post-drying apparatus 190 and is then wound by the winding roller 202.

As above, the manufacturing method and the manufacturing system of the electroless plated fiber material A4 according to the present embodiment can yield effects similar to those of the manufacturing method and the manufacturing system of the electroless plated fiber material A4 according to the first embodiment. In the manufacturing method and the manufacturing system according to the present embodiment, effects as follows can be obtained, in addition to the effects as above.

In the manufacturing method for the electroless plated fiber material A4 according to the present embodiment, the fiber material A2, the catalyst-applied fiber material A3, and the electroless plated fiber material A4 are carried from a position in which the catalyzing step S5 is performed toward a position in which the electroless plating step S7 is performed in a state of being integrated with each other so as to extend from the position in which the catalyzing step S5 is performed toward the position in which the electroless plating step S7 is performed.

The manufacturing system of the electroless plated fiber material A4 according to the present embodiment further includes the carrying apparatus 200 configured to be able to carry the fiber material A2, the catalyst-applied fiber material A3, and the electroless plated fiber material A4 from the catalyzing apparatus 150 toward the electroless plating apparatus 170 in a state of being integrated with each other so as to extend from the catalyzing apparatus 150 toward the electroless plating apparatus 170.

In such a manufacturing method and manufacturing system, the fiber materials A2 to A4 can be efficiently carried. Therefore, the manufacturing efficiency can be improved.

The fiber material A1, the preprocessing fiber material A2, the catalyst-applied fiber material A3, and the electroless plated fiber material A4 are integrated with each other so as to extend from the position in which the degreasing step S1 is performed toward the position in which the post-drying step S9 is performed. When the fiber materials A1 to A4 integrated with each other as above are carried from the position in which the degreasing step S1 is performed toward the position in which the post-drying step S9 is performed, the fiber materials A1 to A4 can be efficiently carried. Therefore, the manufacturing efficiency can be improved.

The embodiments of the present invention have been described above, but the present invention is not limited to the abovementioned embodiments, and the present invention can be modified and changed on the basis of the technical idea thereof.

EXAMPLE

An example and a comparative example are described. In the example, as illustrated in FIG. 2 to FIG. 6, the electroless plated fiber material A4 was produced from the fiber material A1 configured by nylon 6,6. An electroless plated fiber material was also produced from a fiber material configured by nylon 6,6 in the comparative example. Each of the thickness of the fiber material A1 of Example 1 and the thickness of the fiber material of the comparative example was 70 denier.

Example

First, the Example is described. In Example 1, the electroless plated fiber material A4 was manufactured with use of the manufacturing method according to the first embodiment. Specifically, in the degreasing step S1, the fiber material A1 was immersed in the degreasing fluid F. As a result, the fiber material A1 was degreased. An acetone solution F was used as the degreasing fluid F. The atmospheric temperature of the degreasing step S1 was room temperature. The amount of immersing time by which the fiber material A1 was immersed in the acetone solution F was one minute. In the pre-drying step S2, hot air was applied to the fiber material A1 degreased in the degreasing step S1. As a result, the fiber material A1 was dried.

As illustrated in FIG. 5, in the preprocessing step S3, the fiber material A1 dried in the pre-drying step S2 was immersed in the processing fluid G, to thereby perform the pre processing so as to provide a negative charge to the fiber material A1 in order to increase the adhesion between the fiber material A2 after the processing and the plated film. The tannic acid solution G containing the tannic acid was used as the processing fluid G, and the tannic acid processing step S3 was performed as the preprocessing step S3. The concentration of the tannic acid in the tannic acid solution G was 5 mass %. The temperature of the tannic acid solution G was 50° C. The amount of immersing time by which the fiber material A1 was immersed in the tannic acid solution G was five minutes.

As illustrated in FIG. 6, after the pre-processing step S3, the pre-processed fiber material A2 was cleaned with the cleaning fluid H in the pre-cleaning step S4. Purified water was used as the cleaning fluid H.

As illustrated in FIG. 2, in the catalyzing step S5, while the fiber material A2 cleaned in the pre-cleaning step S4 was being grounded and the fiber material A2 is moistened, the catalyst solution B in a state of being electrically charged to a positive potential was electrostatically sprayed onto the fiber material A2. Regarding the electrostatically spraying of the catalyst solution B, the catalyst solution B was prepared by dissolving palladium acetate in a solvent of acetonitrile. The concentration of the palladium acetate in the catalyst solution B was 0.1 mol/L.

The spraying amount of the catalyst solution B from the nozzle 51*a* for catalyst per unit time was 0.03 mL/min, and the catalyst solution B was sprayed onto the fiber material A2 of 30 cm for 5 minutes at that spraying amount. The potential on the side of the nozzle 51*a* for catalyst was +5 kV. The distance between the spraying port 51*b* of the nozzle 51*a* for catalyst and the fiber material A2 was 1 cm. Purified water was supplied to the fiber material A2 in order to moisten the fiber material A2.

After the catalyst solution B was electrostatically sprayed, the first reducing agent solution C in a state of being electrically charged to a positive potential was electrostatically sprayed onto the fiber material A2 while the fiber material A2 was being grounded and the fiber material A2 is moistened. Regarding the electrostatically spraying of the first reducing agent solution C, hydrazine was used as the catalyst contained in the first reducing agent solution C. The concentration of hydrazine in the first reducing agent solution C was 1.0 mol/L. As the solvent of the first reducing agent solution C, a solution of 50% ethanol and 50% water was used.

The spraying amount of the first reducing agent solution C from the nozzle 52*a* for first reducing agent per unit time was 0.03 mL/min, and the first reducing agent solution C was sprayed onto the fiber material A2 of 30 cm for 5 minutes at that spraying amount. The potential on the side of the nozzle 52*a* for the first reducing agent was +5 kV. The distance between the spraying port 52*b* of the nozzle 52*a* for the first reducing agent and the fiber material A2 was 1 cm. Purified water was supplied to the fiber material A2 in order to moisten the fiber material A2.

As illustrated in FIG. 6, after the catalyzing step S5, the catalyst-applied fiber material A3 was cleaned with the cleaning fluid H in the intermediate cleaning step S6. Purified water was used as the cleaning fluid H.

As illustrated in FIG. 3, in the electroless plating step S7, while the catalyst-applied fiber material A3 cleaned in the intermediate cleaning step S6 was being grounded and the fiber material A3 is moistened, each of the metal ion solution D and the second reducing agent solution E, each in a state of being electrically charged to a positive potential, was electrostatically sprayed onto the fiber material A3 such that the metal ion solution D and the second reducing agent solution E reacted with each other in the same electric field on the fiber material A3. The metal ion solution D was prepared by dissolving silver nitrate in a mixed solvent formed by ethanol and water. The concentration of the silver nitrate in the metal ion solution D was 0.3 mol/L.

The spraying amount of the metal ion solution D from the nozzle 61*a* for metal ions per unit time was 0.03 mL/min, and the metal ion solution D was sprayed onto the fiber material A3 of 30 cm for 15 minutes at that spraying amount. The potential on the side of the nozzle 61*a* for metal ions was +5 kV. The distance between the spraying port 61*b* of the nozzle 61*a* for metal ions and the fiber material A3 was 1 cm.

Hydrazine was used as the reducing agent contained in the second reducing agent solution E. The concentration of hydrazine in the second reducing agent solution E was 0.5 mol/L. As the solvent of the second reducing agent solution E, a mixed solution formed by ethanol and water was used.

The spraying amount of the second reducing agent solution E from the nozzle 62*a* for second reducing agent per unit time was 0.03 mL/min, and the second reducing agent solution E was sprayed onto the fiber material A3 of 30 cm for 15 minutes at that spraying amount. The potential on the side of the nozzle 62*a* for the second reducing agent was +5 kV. The distance between the spraying port 62*b* of the nozzle 62*a* for the second reducing agent and the fiber material A3 was 1 cm.

As illustrated in FIG. 6, after the electroless plating step S7, the electroless plated fiber material A4 was cleaned with the cleaning fluid H in the post-cleaning step S8. Purified water was used as the cleaning fluid H.

In the post-drying step S9, hot air was applied to the fiber material A4 cleaned in the post-cleaning step S8. As a result, the fiber material A4 was dried. Then, the electrical resistances of the plurality of electroless plated fiber materials A4 were measured.

Comparative Example

Next, the comparative example is described. In the comparative example, first, the degreasing step, the pre-drying step, the pre-processing step, the pre-cleaning step, the catalyzing step, and the intermediate cleaning step similar to those in the example were performed. Then, the catalyst-applied fiber material cleaned in the intermediate cleaning step was immersed in the second reducing agent solution. The metal ion solution in a state of being electrically charged to a positive potential was electrostatically sprayed onto the catalyst-applied fiber material immersed in the second reducing agent solution by use of electrospraying. As a result, the electroless plated fiber material was obtained. The post-cleaning step and the post-drying step, similar to those in the example, were performed on the electroless plated fiber material. Then, the electrical resistances of the plurality of electroless plated fiber materials were measured.

Comparison of Example and Comparative Example

The electrical conductivities of the plurality of electroless plated fiber materials obtained in the comparative example were remarkably inferior to the electrical conductivities of the plurality of electroless plated fiber materials A4 obtained in the example. In other words, the plurality of electroless plated fiber materials A4 obtained in the example showed sufficient conductivity. In addition, even when the amount of time by which the metal ion solution in a state of being electrically charged to a positive potential was electrostatically sprayed with use of electrospraying was increased in the comparative example, the plurality of electroless plated fiber materials obtained in the comparative example hardly exhibited any conductivity. Therefore, in particular, it was confirmed that the electroless plated fiber material A4 having sufficient conductivity was obtained by the electroless plating step S7 in the example in contrast to the comparative example.

The electrical resistances of the plurality of electroless plated fiber materials A4 obtained in the example were from 1.0 Ω/cm to 1.5 Ω/cm. In addition, the electrical resistance of the electroless plated fiber material of a commercial item is about 2.0 Ω/cm. Therefore, it was confirmed that the electroless plated fiber material A4 obtained in the example had conductivity equal to or greater than that of the electroless plated fiber material of a commercial item.

REFERENCE SIGNS LIST

A2 Pre-processed fiber material (fiber material)
A3 Catalyst-applied fiber material (fiber material)
A4 Electroless plated fiber material (fiber material)
B Catalyst solution
C First reducing agent solution
D Metal ion solution
E Second reducing agent solution
S5 Catalyzing step
S7 Electroless plating step
50, 150 Catalyzing apparatus
51*a*, 151*a* Nozzle for catalyst
52*a*, 152*a* Nozzle for first reducing agent
60, 170 Electroless plating apparatus
61*a*, 171*a* Nozzle for metal ions
62*a*, 172*a* Nozzle for second reducing agent
200 Carrying apparatus

The invention claimed is:

1. A manufacturing method for an electroless plated fiber material, the manufacturing method comprising:

a catalyzing step of electrostatically spraying a catalyst solution containing a catalyst precursor in a state of being electrically charged to a positive potential or a negative potential onto a fiber material which is grounded or electrically charged to a potential opposite from the potential of the catalyst solution and which is moistened, and electrostatically spraying a first reducing agent solution containing a reducing agent of the catalyst precursor in a state of being electrically charged to a positive potential or a negative potential onto the fiber material which is grounded or electrically charged to a potential opposite from the potential of the first reducing agent solution and which is moistened, to thereby obtain a catalyst-applied fiber material in which a catalyst is given to the fiber material; and an electroless plating step of electrostatically spraying each of a metal ion solution containing metal ions and a second reducing agent solution containing a reducing agent of the metal ions each in a state of being electrically charged to a positive potential or a negative potential onto the catalyst-applied fiber material which is grounded or electrically charged to a potential opposite from the potential of the metal ion solution and the second reducing agent solution and which is moistened, such that the metal ion solution and the second reducing agent solution react with each other in a same electric field on the catalyst-applied fiber material by spraying onto the catalyst-applied fiber material using a nozzle for spraying the metal ion solution and a nozzle for spraying the second reducing agent solution that are positioned opposite to each other, wherein the nozzles face the catalyst-applied fiber material, to thereby obtain an electroless plated fiber material in which a plated film is formed on the catalyst-applied fiber material.

2. The manufacturing method for the electroless plated fiber material according to claim 1, wherein the catalyzing step and the electroless plating step are performed in a continuous in-line process.

* * * * *